US010436422B1

(12) United States Patent
Takacs et al.

(10) Patent No.: US 10,436,422 B1
(45) Date of Patent: Oct. 8, 2019

(54) MULTI-FUNCTION ACTIVE ACCESSORIES FOR LED LAMPS

(71) Applicant: SORAA, INC., Fremont, CA (US)

(72) Inventors: Laszlo Takacs, Fremont, CA (US); Wilfred A. Martis, San Francisco, CA (US); Frank Shum, Sunnyvale, CA (US); Artem Mishin, Pacifica, CA (US); Vinod Khosla, Fremont, CA (US); Radha Nayak, Fremont, CA (US); Michael Ragan Krames, Mountain View, CA (US)

(73) Assignee: SORAA, INC., Fremont, CA (US)

( * ) Notice: Subject to any disclaimer, the term of this patent is extended or adjusted under 35 U.S.C. 154(b) by 568 days.

(21) Appl. No.: 14/543,164

(22) Filed: Nov. 17, 2014

Related U.S. Application Data

(63) Continuation-in-part of application No. 14/336,276, filed on Jul. 21, 2014, now Pat. No. 9,995,439, which is a continuation-in-part of application No. 13/894,203, filed on May 14, 2013, now Pat. No. 9,360,190, which is a continuation-in-part of application No. 13/865,760, filed on Apr. 18, 2013,
(Continued)

(51) Int. Cl.

| | |
|---|---|
| ***F21V 33/00*** | (2006.01) |
| ***F21V 17/10*** | (2006.01) |
| ***F21V 17/00*** | (2006.01) |
| ***F21V 5/04*** | (2006.01) |
| ***F21K 99/00*** | (2016.01) |
| *F21Y 101/02* | (2006.01) |

(52) U.S. Cl.
CPC ..... *F21V 17/105* (2013.01); *F21K 9/54* (2013.01); *F21V 5/04* (2013.01); *F21V 17/002* (2013.01); *F21Y 2101/02* (2013.01)

(58) Field of Classification Search
CPC ..... F21V 17/105; F21V 17/002; F21V 5/04; B60Q 1/00; G08C 17/00; G08C 17/02; G08C 17/04; H04N 2005/4407; H05B 33/0842; H05B 37/0218; F21Y 2101/02; F21W 2131/00
USPC ..... 362/253; 361/600; 307/10.8; 315/149; 340/12.22
See application file for complete search history.

(56) References Cited

U.S. PATENT DOCUMENTS

| | | | |
|---|---|---|---|
| 2,953,970 | A | 9/1960 | Maynard |
| 3,283,143 | A | 11/1966 | Gosnell |

(Continued)

FOREIGN PATENT DOCUMENTS

| | | |
|---|---|---|
| CN | 1849707 | 10/2006 |
| CN | 2826150 Y | 10/2006 |

(Continued)

OTHER PUBLICATIONS

Atmel AT25F512 datasheet.*

(Continued)

*Primary Examiner* — William J Carter
*Assistant Examiner* — Omar Rojas Cadima
(74) *Attorney, Agent, or Firm* — FisherBroyles LLP

(57) ABSTRACT

Apparatus and methods of attaching accessories to LED lamps and for providing active accessories in LED lamps are disclosed. The active accessories include single-function active accessories as well as multi-function active accessories.

29 Claims, 20 Drawing Sheets

Related U.S. Application Data now Pat. No. 9,310,052, said application No. 14/336,276 is a continuation-in-part of application No. 13/909,752, filed on Jun. 4, 2013, now Pat. No. 8,888,332, said application No. 14/336,276 is a continuation-in-part of application No. 14/014,112, filed on Jun. 29, 2013, now Pat. No. 9,109,760, which is a continuation-in-part of application No. 13/915,432, filed on Jun. 11, 2013, now abandoned.

(60) Provisional application No. 61/707,757, filed on Sep. 28, 2012, provisional application No. 61/646,766, filed on May 14, 2012, provisional application No. 61/776,173, filed on Mar. 11, 2013, provisional application No. 61/655,894, filed on Jun. 5, 2012, provisional application No. 61/659,386, filed on Jun. 13, 2012.

(56) References Cited

U.S. PATENT DOCUMENTS 3,593,021 A 7/1971 Auerbach
3,621,233 A 11/1971 Harry et al.
3,874,443 A 4/1975 Bayer, Jr.
4,165,919 A 8/1979 Little
4,225,904 A 9/1980 Linder
4,279,463 A 7/1981 Little
4,293,892 A 10/1981 Plummer
5,005,109 A 4/1991 Carleton
5,764,674 A 6/1998 Hibbs-Brenner et al.
6,116,758 A 9/2000 Lin
6,204,602 B1 3/2001 Yang et al.
6,501,154 B2 12/2002 Morita et al.
D471,881 S 3/2003 Hegde
6,577,080 B2 * 6/2003 Lys ..... H05B 33/0803 315/292
6,787,999 B2 9/2004 Stimac et al.
6,864,572 B2 3/2005 Lee et al.
6,889,006 B2 5/2005 Kobayashi
6,942,368 B1 9/2005 Kane et al.
6,964,877 B2 11/2005 Chen et al.
7,207,694 B1 4/2007 Petrick
D545,457 S 6/2007 Chen
7,311,417 B1 12/2007 Lemke
7,318,659 B2 * 1/2008 Demarest ..... A61M 11/041 362/253
7,344,279 B2 3/2008 Mueller et al.
7,388,751 B2 6/2008 Hood et al.
7,431,071 B2 10/2008 Wenger
D581,583 S 11/2008 Peng
7,458,706 B1 12/2008 Liu et al.
7,488,097 B2 2/2009 Reisenauer et al.
7,506,998 B2 3/2009 Ansems et al.
D592,613 S 5/2009 Plonski et al.
7,631,987 B2 12/2009 Wei
7,637,635 B2 12/2009 Xiao et al.
7,658,528 B2 2/2010 Hoelen et al.
7,663,229 B2 2/2010 Lu et al.
7,674,015 B2 3/2010 Chien
7,712,922 B2 5/2010 Hacker et al.
D618,634 S 6/2010 Lin et al.
7,744,259 B2 6/2010 Walczak et al.
D619,551 S 7/2010 Lin et al.
7,748,870 B2 7/2010 Chang et al.
7,753,107 B2 7/2010 Zhou et al.
7,800,119 B2 9/2010 He et al.
7,824,075 B2 11/2010 Maxik
7,824,077 B2 11/2010 Chen et al.
7,889,421 B2 2/2011 Narendran et al.
7,972,040 B2 7/2011 Li et al.
7,993,025 B2 8/2011 Chiu
7,993,031 B2 8/2011 Grajcar
7,997,774 B2 8/2011 Liddle
8,042,969 B2 10/2011 Paik et al.
8,049,122 B2 11/2011 Watford
D652,564 S 1/2012 Maxik
8,153,475 B1 4/2012 Shum et al.
8,157,422 B2 4/2012 Paik et al.
8,164,237 B2 4/2012 Wen
8,206,015 B2 6/2012 Cho et al.
D662,899 S 7/2012 Shum et al.
D662,900 S 7/2012 Shum et al.
8,215,800 B2 7/2012 Plank
8,220,970 B1 7/2012 Khazi et al.
8,227,962 B1 7/2012 Su
8,242,669 B2 8/2012 Qiu
8,272,762 B2 9/2012 Maxik et al.
8,324,835 B2 12/2012 Shum et al.
D674,960 S 1/2013 Chen et al.
8,390,207 B2 3/2013 Dowling et al.
8,405,947 B1 3/2013 Green et al.
8,414,151 B2 4/2013 Allen et al.
8,525,396 B2 9/2013 Shum et al.
8,567,999 B2 10/2013 Paik et al.
8,579,470 B1 11/2013 Leahy et al.
D694,722 S 12/2013 Shum et al.
8,618,742 B2 12/2013 Shum et al.
8,643,257 B2 2/2014 Shum et al.
8,651,711 B2 2/2014 Rudisill et al.
8,680,787 B2 3/2014 Veskovic
8,746,918 B1 6/2014 Rubino
8,752,975 B2 6/2014 Rubino
8,803,452 B2 8/2014 Shum et al.
8,829,774 B1 9/2014 Shum et al.
8,884,501 B2 11/2014 Cho et al.
8,884,517 B1 11/2014 Shum et al.
8,888,332 B2 11/2014 Martis et al.
2001/0021073 A1 9/2001 Leggo et al.
2002/0014535 A1 * 2/2002 Okada ..... G06K 7/0013 235/492
2002/0119702 A1 * 8/2002 Chen ..... H01R 13/659 439/607.01
2003/0039122 A1 2/2003 Cao
2003/0058650 A1 3/2003 Shih
2003/0107885 A1 6/2003 Galli
2003/0183835 A1 10/2003 Moku et al.
2003/0197807 A1 * 10/2003 Wu ..... G08B 13/19619 348/375
2004/0222427 A1 11/2004 Hsiung
2004/0264195 A1 12/2004 Chang et al.
2005/0122690 A1 6/2005 Hood et al.
2005/0174780 A1 8/2005 Park
2005/0214992 A1 9/2005 Chakraborty et al.
2006/0028310 A1 2/2006 Asano et al.
2006/0175045 A1 8/2006 Chen
2006/0202851 A1 * 9/2006 Cash ..... H05B 37/0272 340/12.23
2006/0208091 A1 * 9/2006 Nishizawa ..... G06F 13/4081 235/492
2006/0262545 A1 11/2006 Piepgras et al.
2006/0274529 A1 12/2006 Cao
2007/0007898 A1 1/2007 Bruning
2007/0158797 A1 7/2007 Lee
2007/0228999 A1 10/2007 Kit
2007/0284564 A1 12/2007 Biwa et al.
2007/0285921 A1 * 12/2007 Zulim ..... F21S 2/00 362/240
2008/0002444 A1 1/2008 Shekhawat et al.
2008/0049399 A1 2/2008 Lu et al.
2008/0080137 A1 4/2008 Otsuki et al.
2008/0123341 A1 5/2008 Chiu
2008/0142781 A1 6/2008 Lee
2008/0158887 A1 7/2008 Zhu et al.
2008/0164489 A1 7/2008 Schmidt et al.
2008/0266866 A1 10/2008 Tsai
2008/0272714 A1 * 11/2008 Noble ..... F21L 4/027 315/292
2008/0315228 A1 12/2008 Krames et al.
2009/0027878 A1 1/2009 Metz et al.
2009/0072252 A1 3/2009 Son et al.
2009/0134421 A1 5/2009 Negley
2009/0154166 A1 6/2009 Zhang et al.
2009/0161356 A1 6/2009 Negley et al.

(56) References Cited

U.S. PATENT DOCUMENTS

| | | | | |
|---|---|---|---|---|
| 2009/0175043 | A1 | 7/2009 | Frick | |
| 2009/0194252 | A1 | 8/2009 | Lee et al. | |
| 2009/0195186 | A1 | 8/2009 | Guest et al. | |
| 2009/0231895 | A1 | 9/2009 | Hu | |
| 2009/0237940 | A1 | 9/2009 | Wu et al. | |
| 2009/0244899 | A1 | 10/2009 | Chyn | |
| 2009/0303738 | A1 | 12/2009 | Suss et al. | |
| 2009/0303762 | A1 | 12/2009 | Jang et al. | |
| 2010/0060130 | A1 | 3/2010 | Li | |
| 2010/0061076 | A1 | 3/2010 | Mandy et al. | |
| 2010/0066266 | A1 | 3/2010 | Huang et al. | |
| 2010/0091487 | A1 | 4/2010 | Shin | |
| 2010/0118148 | A1* | 5/2010 | Lee | F21V 3/00 348/164 |
| 2010/0148145 | A1 | 6/2010 | Ishibashi et al. | |
| 2010/0207502 | A1 | 8/2010 | Cao et al. | |
| 2010/0207534 | A1 | 8/2010 | Dowling et al. | |
| 2010/0244648 | A1 | 9/2010 | Yoo | |
| 2010/0264799 | A1 | 10/2010 | Liu et al. | |
| 2010/0277068 | A1 | 11/2010 | Broitzman | |
| 2010/0290229 | A1 | 11/2010 | Meyer, Sr. et al. | |
| 2010/0320499 | A1 | 12/2010 | Catalano et al. | |
| 2011/0018418 | A1 | 1/2011 | Yoo | |
| 2011/0032708 | A1 | 2/2011 | Johnston et al. | |
| 2011/0056429 | A1 | 3/2011 | Raring et al. | |
| 2011/0074270 | A1 | 3/2011 | Van De Ven et al. | |
| 2011/0095686 | A1 | 4/2011 | Falicoff et al. | |
| 2011/0140586 | A1 | 6/2011 | Wang | |
| 2011/0169406 | A1 | 7/2011 | Weekamp et al. | |
| 2011/0175510 | A1 | 7/2011 | Rains, Jr. et al. | |
| 2011/0175528 | A1 | 7/2011 | Rains, Jr. et al. | |
| 2011/0182065 | A1 | 7/2011 | Negley et al. | |
| 2011/0198979 | A1 | 8/2011 | Shum et al. | |
| 2011/0204763 | A1 | 8/2011 | Shum et al. | |
| 2011/0204779 | A1 | 8/2011 | Shum et al. | |
| 2011/0204780 | A1 | 8/2011 | Shum et al. | |
| 2011/0215699 | A1 | 9/2011 | Le et al. | |
| 2011/0242823 | A1 | 10/2011 | Tracy et al. | |
| 2011/0260945 | A1 | 10/2011 | Karasawa | |
| 2011/0298371 | A1 | 12/2011 | Brandes et al. | |
| 2011/0309734 | A1 | 12/2011 | Lin et al. | |
| 2012/0018754 | A1 | 1/2012 | Lowes | |
| 2012/0043552 | A1 | 2/2012 | David et al. | |
| 2012/0043913 | A1 | 2/2012 | Melanson | |
| 2012/0161626 | A1 | 6/2012 | van de Ven et al. | |
| 2012/0187830 | A1 | 7/2012 | Shum et al. | |
| 2012/0212960 | A1 | 8/2012 | Rodriguez | |
| 2012/0215325 | A1* | 8/2012 | Wu | H05B 33/0803 700/11 |
| 2012/0293062 | A1 | 11/2012 | Pickard | |
| 2012/0314403 | A1 | 12/2012 | Kennedy et al. | |
| 2012/0319148 | A1 | 12/2012 | Donofrio et al. | |
| 2012/0320579 | A1 | 12/2012 | Ferguson et al. | |
| 2013/0058099 | A1 | 3/2013 | Shum et al. | |
| 2013/0322089 | A1 | 12/2013 | Martis et al. | |
| 2013/0343062 | A1 | 12/2013 | Shum et al. | |
| 2014/0028214 | A1 | 1/2014 | Mazumdar et al. | |
| 2014/0091697 | A1 | 4/2014 | Shum | |
| 2014/0146545 | A1 | 5/2014 | Shum et al. | |
| 2014/0175966 | A1 | 6/2014 | Tan | |
| 2014/0268750 | A1 | 9/2014 | Lui et al. | |
| 2014/0313749 | A1 | 10/2014 | Shum et al. | |

FOREIGN PATENT DOCUMENTS

| | | |
|---|---|---|
| CN | 2009-75612 | 11/2007 |
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2005-302483 | 10/2009 |
| JP | 2011-501351 | 1/2011 |
| TW | M425985 U * | 4/2012 |
| WO | WO 2009/048956 | 3/2009 |
| WO | WO 2009/149263 | 12/2009 |
| WO | WO 2009/156969 | 12/2009 |
| WO | WO 2011/054716 | 5/2011 |

OTHER PUBLICATIONS

Haskell et al., 'Defect Reduction in (1100) m-plane gallium nitride via lateral epitaxial overgrowth by hydride vapor phase epitaxy', Applied Physics Letters 86, 111917 (2005), pp. 1-3.

Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.

International Preliminary Report & Written Opinion of PCT Application No. PCT/US2011/060030 dated Mar. 21, 2012, 11 pgs. total.

CFL Ballast IC Drive LED, www.placardshop.com, Blog, May 22, 2012, 3 pgs.

Themial Properties of Plastic Materials, Professional Plastics, Aug. 21, 2010, pp. 1-4.

Rausch, 'Use a CFL ballast to drive LEDs', EDN Network, 2007, pp. 1-2.

Communication from the Japanese Patent Office re 2013532993 dated Jul. 9, 2014 (5 pages).

Communication from the Japanese Patent Office re 2012191931, dated Oct. 11, 2013 (4 pages).

Communication from the Chinese Patent Office re 201210322687.1 dated Mar. 3, 2014, (8 pages).

USPTO Office Action for U.S. Appl. No. 12/785,953 dated Apr. 12, 2012 (11 pages).

USPTO Office Action for U.S. Appl. No. 12/785,953 dated Jan. 11, 2013 (14 pages).

USPTO Office Action for U.S. Appl. No. 13/025,791 dated Nov. 25, 2011 (11 pages).

USPTO Office Action for U.S. Appl. No. 13/025,791 dated Feb. 20, 2013 (13 pages).

USPTO Notice of Allowance for U.S. Appl. No. 13/025,791 dated Jun. 17, 2013 (8 pages).

USPTO Office Action for U.S. Appl. No. 13/025,833 dated Dec. 14, 2011 (10 pages).

USPTO Office Action for U.S. Appl. No. 13/025,833 dated Jul. 12, 2012 (15 pages).

USPTO Office Action for U.S. Appl. No. 13/025,833 dated Apr. 26, 2013 (22 pages).

USPTO Notice of Allowance for U.S. Appl. No. 13/025,833 dated Oct. 11, 2013 (11 pages).

USPTO Office Action for U.S. Appl. No. 13/025,849 dated Mar. 15, 2013 (17 pages).

USPTO Notice of Allowance for U.S. Appl. No. 13/025,849 dated Sep. 16, 2013 (10 pages).

USPTO Office Action for U.S. Appl. No. 13/025,860 dated Dec. 30, 2011 (14 pages).

USPTO Notice of Allowance for U.S. Appl. No. 13/025,860 dated Jun. 8, 2012 (9 pages).

USPTO Office Action for U.S. Appl. No. 13/269,193 dated Oct. 3, 2013 (12 pages).

USPTO Notice of Allowance for U.S. Appl. No. 13/269,193 dated Mar. 31, 2014 (8 pages).

USPTO Office Action for U.S. Appl. No. 13/274,489 dated Sep. 6, 2013 (12 pages).

USPTO Office Action for U.S. Appl. No. 13/274,489 dated Mar. 27, 2014 (14 pages).

USPTO Notice of Allowance for U.S. Appl. No. 13/274,489 dated Sep. 30, 2014 (7 pages).

USPTO Office Action for U.S. Appl. No. 13/480,767 dated Oct. 25, 2013 (28 pages).

USPTO Office Action for U.S. Appl. No. 13/480,767 dated Apr. 29, 2014 (21 pages).

USPTO Office Action for U.S. Appl. No. 13/535,142 dated Aug. 1, 2013 (13 pages).

USPTO Office Action for U.S. Appl. No. 13/535,142 dated Nov. 14, 2013 (23 pages).

(56) References Cited

OTHER PUBLICATIONS

USPTO Office Action for U.S. Appl. No. 13/535,142 dated Feb. 25, 2014 (23 pages).
USPTO Office Action for U.S. Appl. No. 13/535,142 dated Sep. 22, 2014 (25 pages).
USPTO Notice of Allowance for U.S. Appl. No. 13/856,613 dated Nov. 21, 2014 (8 pages).
USPTO Notice of Allowance for U.S. Appl. No. 13/909,752 dated Sep. 30, 2014 (9 pages).
USPTO Office Action for U.S. Appl. No. 13/959,422 dated Oct. 8, 2013 (10 pages).
USPTO Notice of Allowance for U.S. Appl. No. 13/959,422 dated Jul. 9, 2014 (7 pages).
USPTO Office Action for U.S. Appl. No. 14/014,112 dated Nov. 19, 2014 (24 pages).
USPTO Office Action for U.S. Appl. No. 14/054,597 dated Dec. 5, 2014 (9 pages).
USPTO Office Action for U.S. Appl. No. 14/075,936 dated Sep. 24, 2014 (7 pages).
USPTO Office Action for U.S. Appl. No. 14/097,043 dated Oct. 15, 2014 (11 pages).
USPTO Office Action for U.S. Appl. No. 14/211,606 dated Nov. 28, 2014 (18 pages).
USPTO Notice of Allowance for U.S. Appl. No. 29/399,523 dated Mar. 5, 2012 (7 pages).
USPTO Notice of Allowance for U.S. Appl. No. 29/399,524 dated Mar. 2, 2012 (8 pages).
USPTO Notice of Allowance for U.S. Appl. No. 29/423,725 dated Jul. 19, 2013 (9 pages).
Tyagi et al., 'Partial Strain relaxation via misfit dislocation generation at heterointerfaces in (Al,In)GaN epitaxial layers grown on semipolar (1122) GaN free standing substrates', Applied Physics Letters 95, (2009) pp. 251905.
Communication from the Chinese Patent Office re 2011800543977 dated Jan. 7, 2015 (13 pages).
USPTO Office Action for U.S. Appl. No. 13/480,767 dated Dec. 18, 2014 (17 pages).
USPTO Office Action for U.S. Appl. No. 13/855,423 dated Mar. 17, 2015 (22 pages).
USPTO Notice of Allowance for U.S. Appl. No. 29/441,108 dated Mar. 13, 2015 (7 pages).
USPTO Notice of Allowance for U.S. Appl. No. 29/469,709 dated Feb. 6, 2015 (5 pages).

* cited by examiner

1600

1700

1800

1900

MULTI-FUNCTION ACTIVE ACCESSORIES FOR LED LAMPS

This application is a continuation-in-part of U.S. application Ser. No. 14/336,276, filed on Jul. 21, 2014, which is incorporated by reference in its entirety. U.S. application Ser. No. 14/336,276 is a continuation-in-part of U.S. application Ser. No. 13/894,203 filed on May 14, 2013, which is a continuation-in-part of U.S. application Ser. No. 13/865,760 filed on Apr. 18, 2013, which claims benefit under 35 U.S.C. § 119(e) to U.S. Provisional Application No. 61/707,757 filed on Sep. 28, 2012, and U.S. application Ser. No. 13/894,203 claims the benefit under 35 U.S.C. § 119(e) to U.S. Provisional Application No. 61/646,766 filed on May 14, 2012; and U.S. application Ser. No. 14/336,276 is a continuation-in-part of U.S. application Ser. No. 13/909,752 filed on Jun. 4, 2013, which claims benefit under 35 U.S.C. § 119(e) to U.S. Provisional Application No. 61/776,173 filed on Mar. 11, 2013, and to U.S. Provisional Application No. 61/655,894 filed on Jun. 5, 2012; and U.S. application Ser. No. 14/336,276 is a continuation-in-part of U.S. application Ser. No. 14/014,112 filed on Aug. 29, 2013, which is a continuation-in-part of U.S. application Ser. No. 13/915,432 filed on Jun. 11, 2013, which claims benefit under 35 U.S.C. § 119(e) to U.S. Application No. 61/659,386 filed on Jun. 13, 2012, each of which is incorporated by reference in its entirety.

FIELD

The disclosure relates to the field of LED illumination and more particularly to techniques for making and using active accessories for LED lamps.

BACKGROUND

Accessories for standard halogen lamps such as MR16 lamps include, for example, diffusers, color filters, polarizers, linear dispersion, and baffles. Such accessories are commercially available from companies such as Abrisa, Rosco, and Lee Filters. These accessories can be used to control the quality of light including elimination of glare, to change the color temperature of the lamp, or to tailor a beam profile for a particular application.

Generally, accessories for halogen lamps are required to withstand high temperature and may be made of glass, and often require special mechanical holders or fixtures to incorporate with the halogen lamp. Often, such halogen lamp accessories require disassembly of the lamp from the fixture to incorporate the accessory into the fixture. This set of disadvantages results in the accessories having high costs and being cumbersome to install.

At the same time, miniaturized electronics have become very small and relatively inexpensive, thus providing an opportunity to deploy miniaturized electronics adapted as active accessories in conjunction with LED lamps.

Therefore, there is a need for improved approaches for configuring selections of one or more active and/or passive accessories to mate with LED lamps.

SUMMARY

This disclosure relates to apparatus allowing for simple and low cost implementation of accessories for LED lamps that can be used to retrofit existing fixtures. In other words, the accessories disclosed herein are compatible with fixtures that may not have been designed to be used with such accessories. In certain embodiments, disassembly of LED lamps is not necessary for installation of the accessories.

Many of the embodiments herein address use of an active electronic component that is integrated into or used with an LED lamp. Some implement electronic circuitry in a base, and some implement electronic circuitry (including connectivity) in a "smart" adapter. Examples of such embodiments are included in the appended figures and in the description.

BRIEF DESCRIPTION OF THE DRAWINGS

Those skilled in the art will understand that the drawings, described herein, are for illustration purposes only. The drawings are not intended to limit the scope of the present disclosure. This patent or application file contains at least one drawing executed in color. Copies of this patent or patent application publication with color drawings will be provided by the U.S. Patent and Trademark Office upon request and payment of the necessary fee.

DETAILED DESCRIPTION

The term "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The term "or" is intended to mean an inclusive "or" rather than an exclusive "or". That is, unless specified otherwise, or is clear from the context, "X employs A or B" is intended to mean any of the natural inclusive permutations. That is, if X employs A, X employs B, or X employs both A and B, then "X employs A or B" is satisfied under any of the foregoing instances. In addition, the articles "a" and "an" as used in this application and the appended claims should generally be construed to mean "one or more" unless specified otherwise or is clear from the context to be directed to a singular form.

"Accessory" or "accessories" includes any mechanical or electro-mechanical component or electrical component or fixture to be mated to a lamp. In certain embodiments, an accessory comprises a thin, optically transparent film, sheet, or plate.

Reference is now made in detail to certain embodiments. The disclosed embodiments are not intended to be limiting of the claims.

Figure 1:
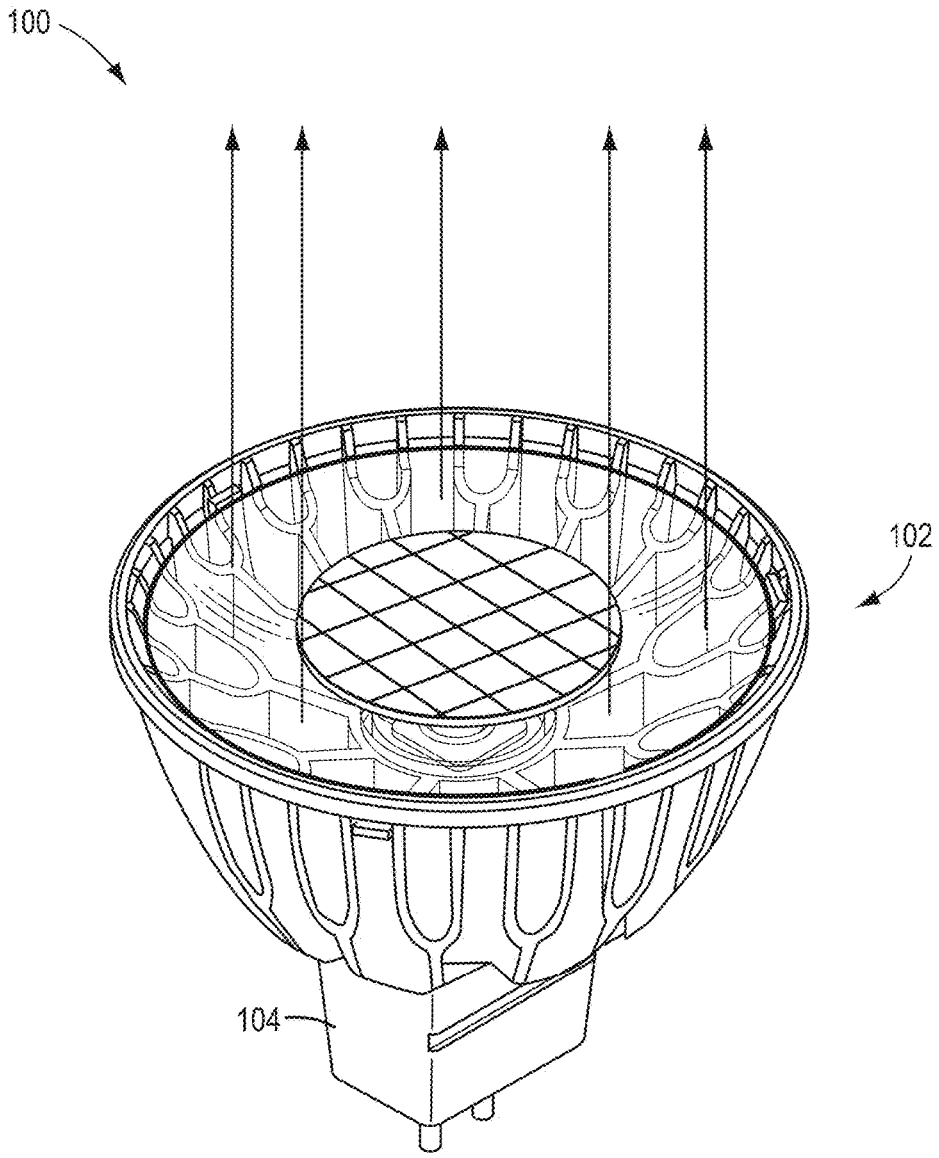
FIG. 1 shows a housing for implementing active accessories in an LED lamp, according to some embodiments.

FIG. 1 shows a housing 100 for implementing active accessories in an LED lamp. The LED lamp includes a heat sink 102 and a base 104 and light (arrows) emanating from the optic.

In some embodiments, the housing has an inner volume (center cross-hatched area) suited for situating electronic components such as power conditioning circuitry and/or microprocessors and sensors.

Figure 2:
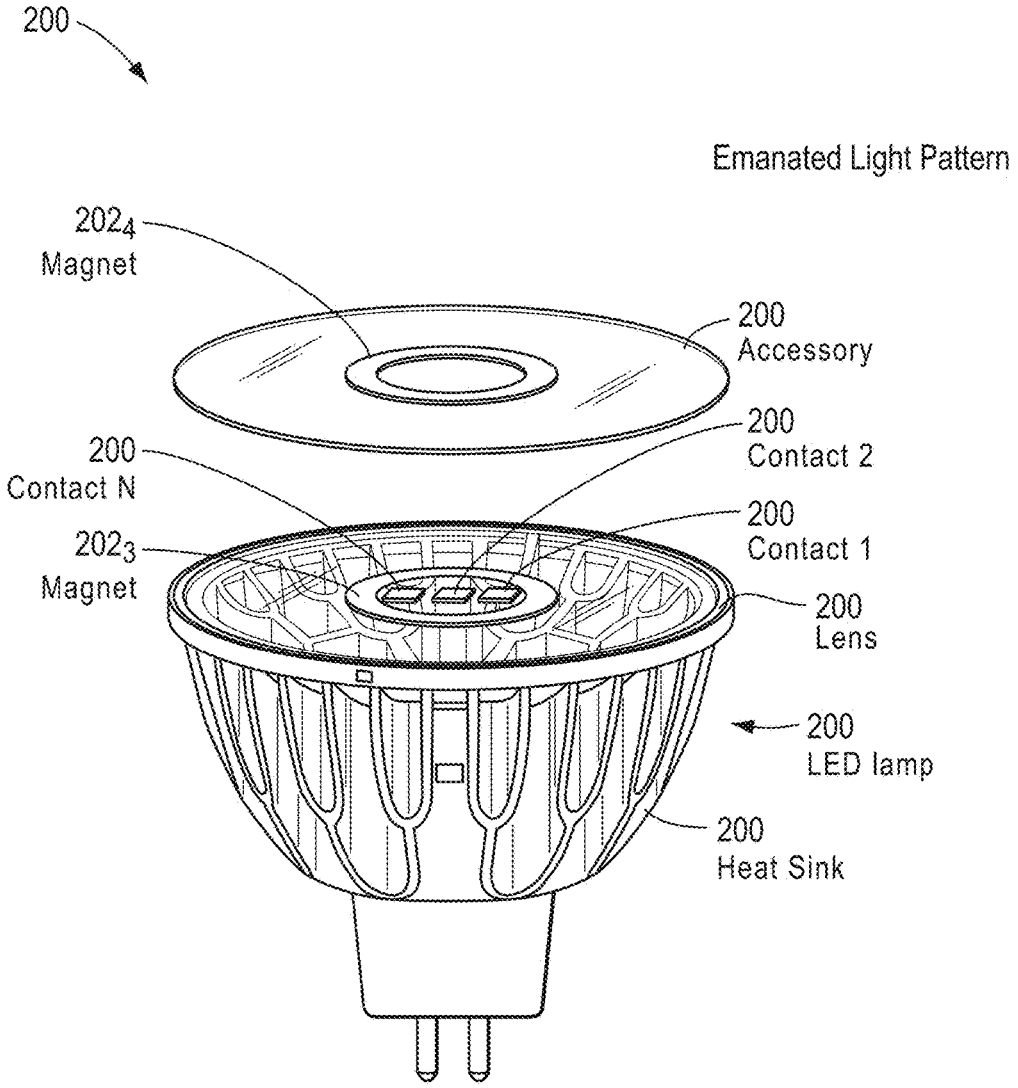
FIG. 2 shows an adapter used to provide active accessories in an LED lamp, according to some embodiments.

FIG. 2 shows an adapter 200 used to provide active accessories in an LED lamp. The LED lamp includes a heat sink, lens, magnet 2023, magnet 2024, an accessory, and electrical contacts N 200 (contact N, contact 1 and contact 2).

A plurality of contacts can be positioned atop the lens, and the contacts can be configured to provide an electrical connection to electronic components such as power conditioning circuitry and/or microprocessors and sensors. In some embodiments, an adapter uses magnetic forces to hold an accessory in place.

Figure 3:
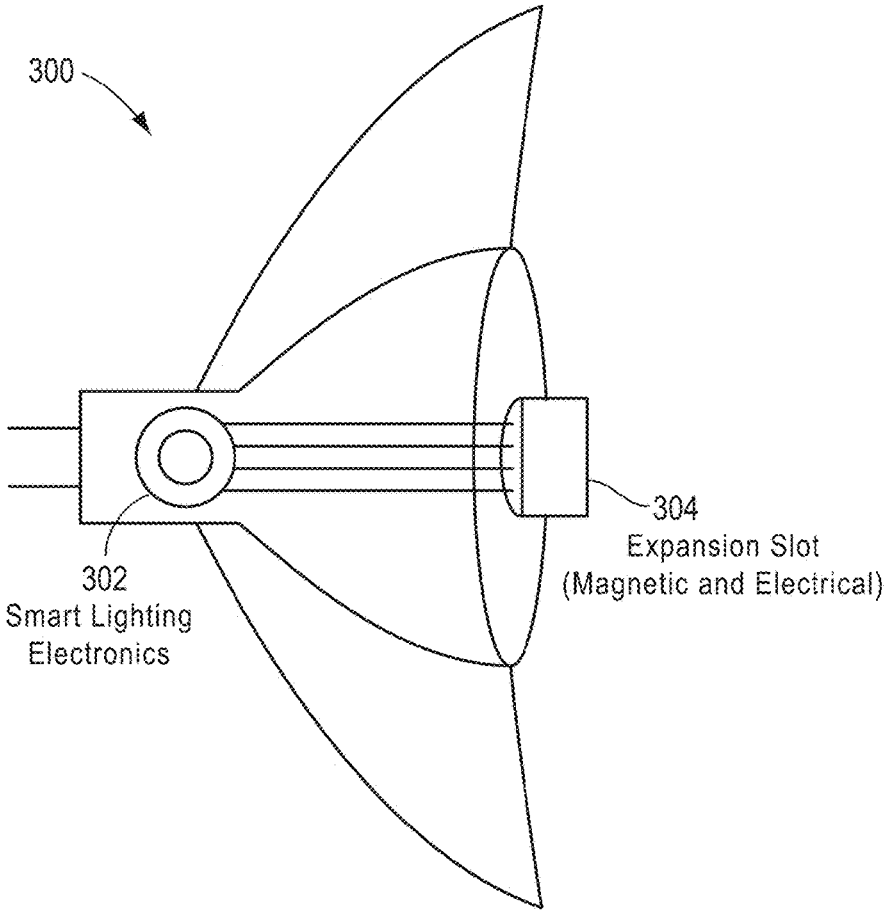
FIG. 3 shows superimposed profile shapes found in a range of lamp standards adapted to be used for providing active accessories in an LED lamp, according to some embodiments.

FIG. 3 shows superimposed profile shapes 300 found in a range of lamp standards adapted to be used for providing active accessories in an LED lamp. FIG. 3 also shows smart light electronics 302 electrically connected to an adapter within expansion slot 304.

A home or business may have several lamp types installed. Creating a set of smart accessories that fit any/all of these lamp types, and communicate with each other and with a central computer, in a consistent manner enables the consumer or business owner to monitor and control their environment efficiently and effectively. The accessories can have unique identifications and communicate with each other and a central computer using standard protocols such as uPnP, DLNA, or other interoperable or interoperability protocols. By using an expandable approach (e.g., using smart buttons versus a pre-integrated one that has the smarts built into each lamp) allows the lamps to be integrated into any operational environment of building management systems or smart lighting systems using a choice of smart buttons, and without having to replace the lamps.

Figure 4:
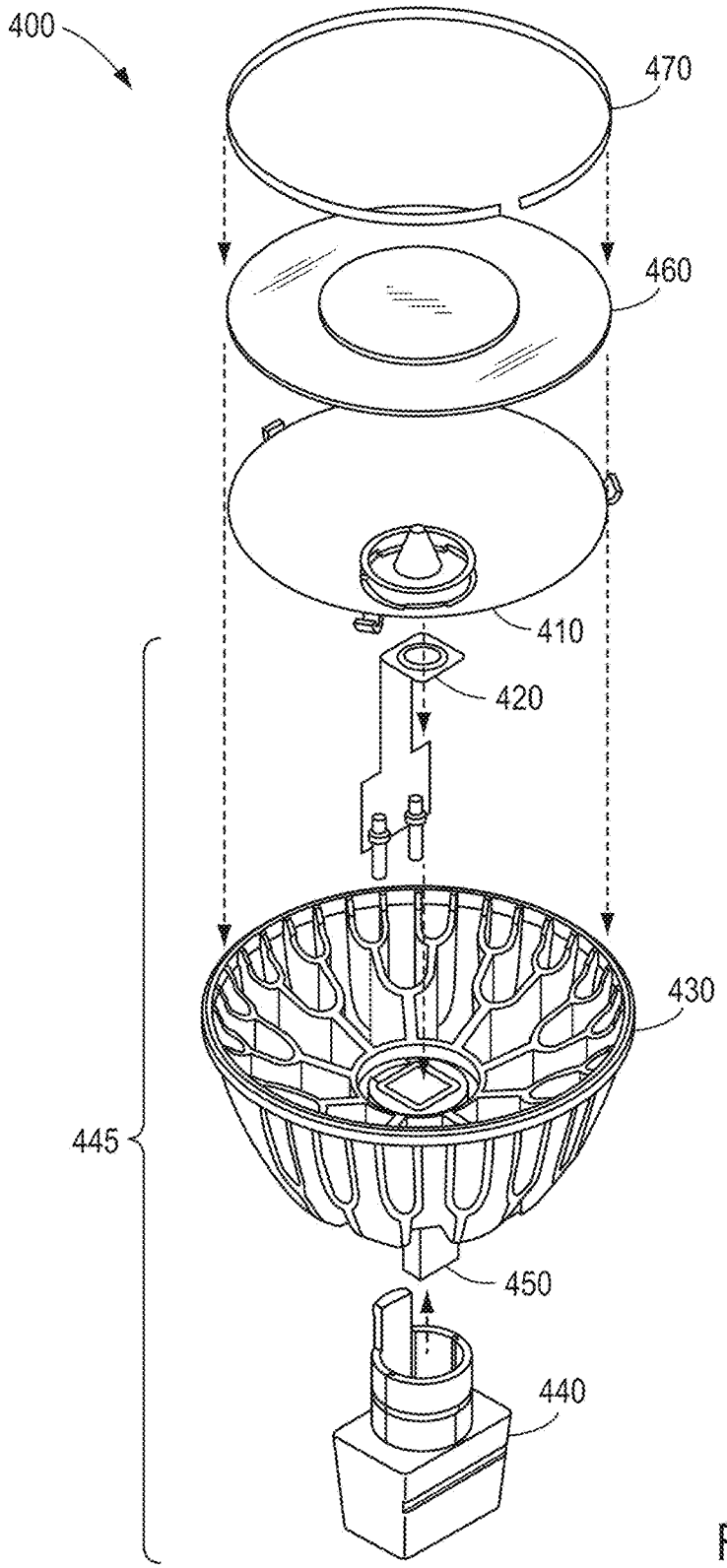
FIG. 4 shows an exploded view of an assembly found in a range of lamp standards adapted to be used for providing active accessories in an LED lamp, according to some embodiments.

FIG. 4 shows an exploded view of an assembly 400 found in a range of lamp standards adapted to be used for providing active accessories in an LED lamp. The LED lamp includes a base 440, a plug 450, a heat sink 430, a circuit including the LED 420, retaining ring 410, optic 460, and retaining ring 470.

Figure 5:
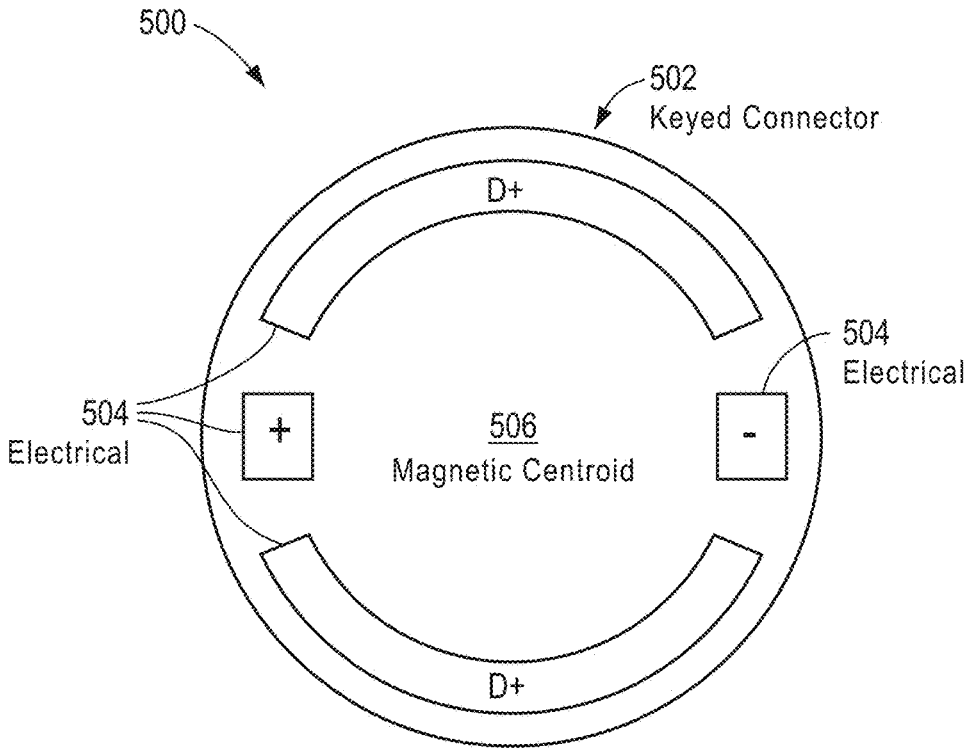
FIG. 5 shows a top view of a hybrid connector adapted to be used for providing active accessories in an LED lamp, according to some embodiments.

FIG. 5 shows a top view of a hybrid connector 500 adapted to be used for providing active accessories in an LED lamp. The adaptor includes electrical contacts 504, a keyed connector 502, and a magnetic centroid 506.

A standard interface like USB can be implemented using a simple connector with 4 or 5 terminals that carry power and data. USB provides the opportunity to leverage the vast ecosystem of systems and devices that have been built for the past few decades for PCs, CE devices, smartphones, etc., as well as the continuous evolution of the interface to accommodate new usages for consumers and businesses.

Figure 6:
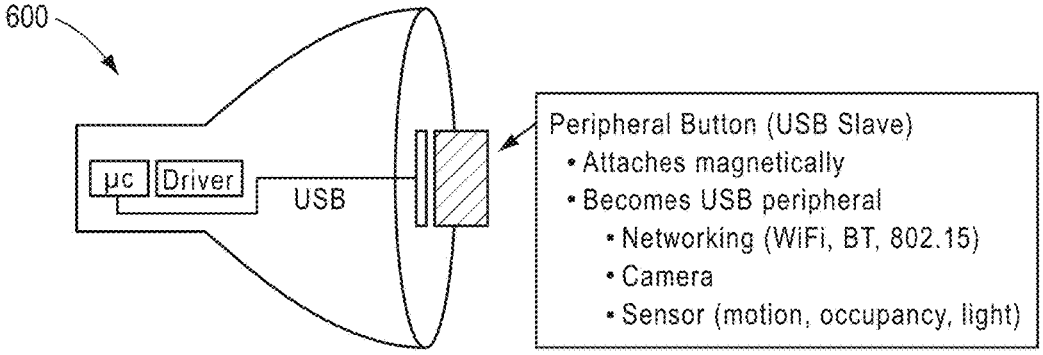
FIG. 6 shows a side view of a hybrid connector adapted to be used as a USB slave device for providing active accessories in an LED lamp, according to some embodiments.

FIG. 6 shows a side view of a hybrid connector 600 adapted to be used as a USB slave device for providing active accessories in an LED lamp.

A lamp can be built with a standard microcontroller or microprocessor with associated software, and with or without persistent connectivity to other devices or a central computer. The microcontroller or microprocessor can be used for internal lamp functions like controlling the LED driver, storing operational data like hours of usage, current and temperature data, etc. By attaching a smart USB Slave button, the functionality of the lamp can be extended to include wireless communication to other lamps and a central computer for lamp monitoring and control, connection to peripheral devices like a camera and sensors.

Figure 7:
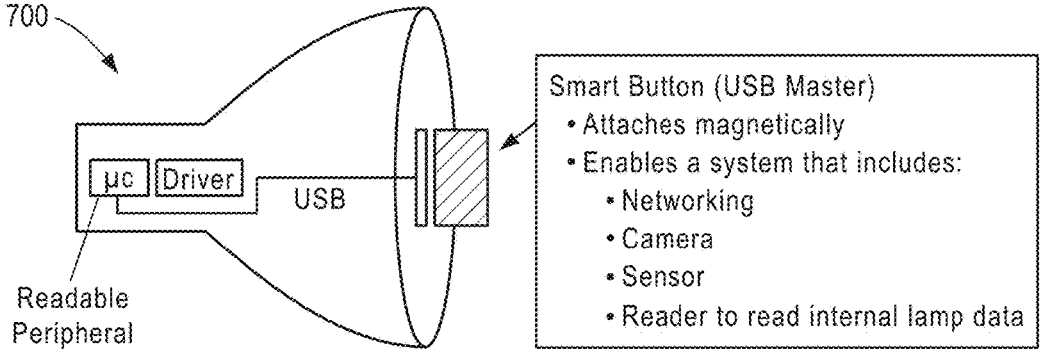
FIG. 7 shows a side view of a hybrid connector adapted to be used as a USB master device for providing active accessories in an LED lamp, according to some embodiments.

FIG. 7 shows a side view of a hybrid connector 700 adapted to be used as a USB master device for providing active accessories in an LED lamp.

A lamp can be built with even without a microcontroller or microprocessor, yet supporting a simple USB-based readable storage that stores operational data of the lamp like hours of usage, current and temperature data, etc. Once a smart USB Master button that has a microcontroller or microprocessor is connected to the lamp, that USB device can be read by the microcontroller or microprocessor on the smart button. The smart button can also integrate wireless networking to implement lamp monitoring and control, and can communicate with other lamps and/or can communicate with a central computer. It may also contain a camera and/or other sensors.

Figure 8:
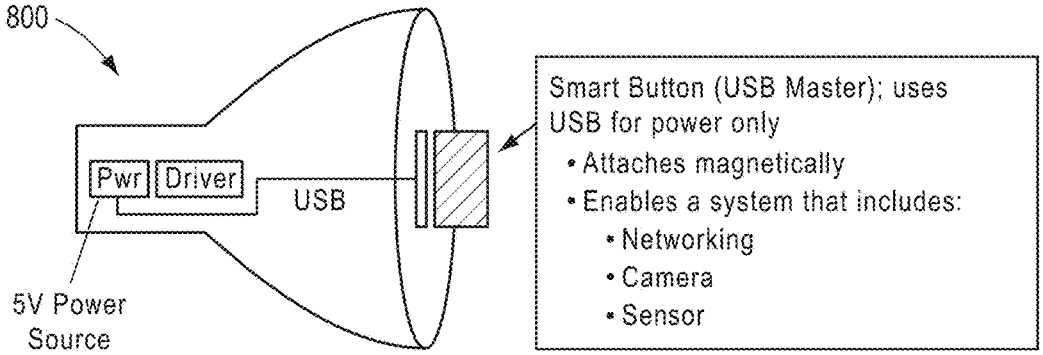
FIG. 8 shows a side view of a hybrid connector adapted to be used as power-delivery device for providing active accessories in an LED lamp, according to some embodiments.

FIG. 8 shows a side view of a hybrid connector 800 adapted to be used as power-delivery device for providing active accessories in an LED lamp.

A lamp can be built with a device that provides power to the smart button connector. When a smart USB Master button that has a microcontroller or microprocessor is connected to the lamp, the lamp can be turned into a smart lamp. The smart button can integrate wireless networking to implement lamp monitoring and control, and communication with other lamps and a central computer. It may also contain a camera and sensors. It may also contain readable storage that stores operational data of the lamp such as hours of usage, current and temperature data, etc.

Figure 9:
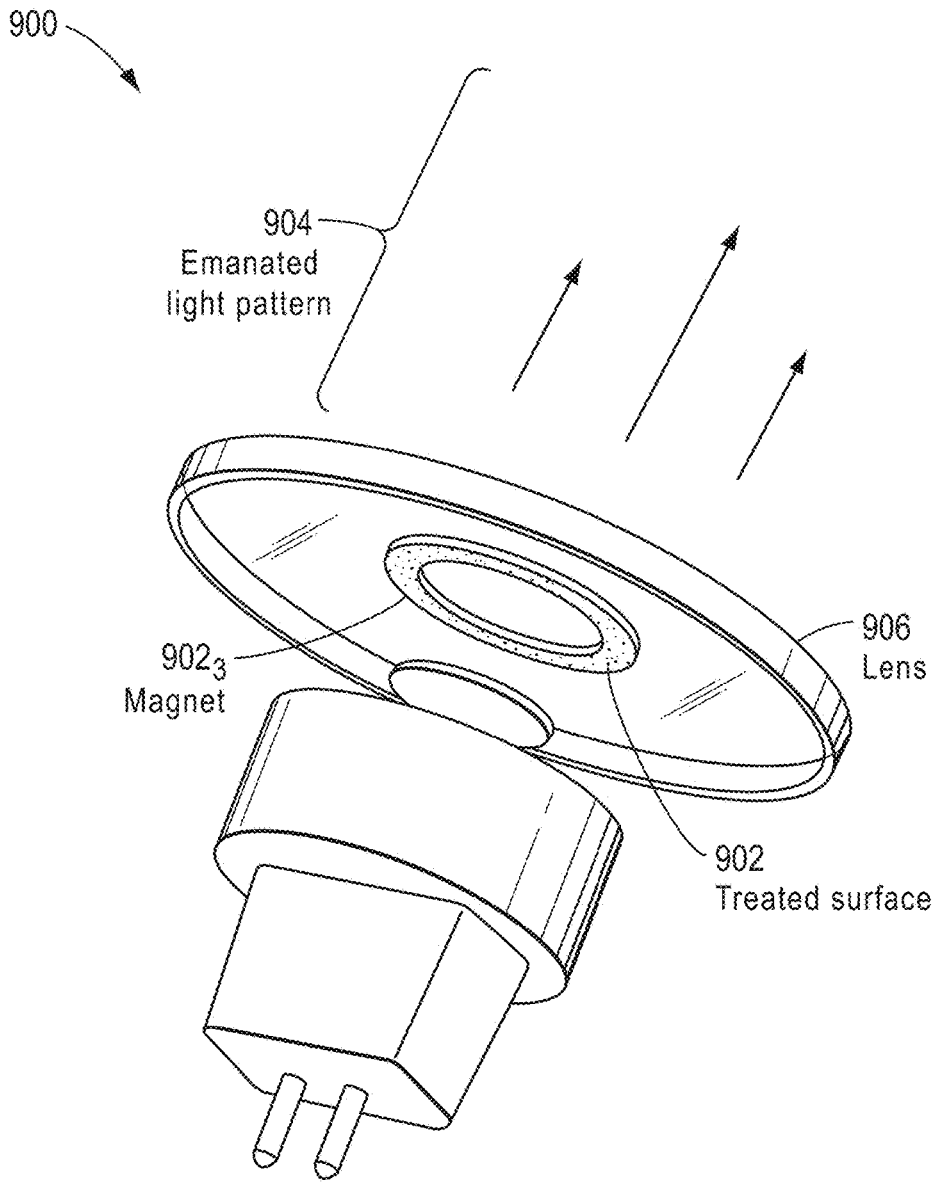
FIG. 9 shows an exploded view of an assembly found in a range of lamp standards adapted to be used for providing active accessories in an LED lamp, according to some embodiments.

FIG. 9 shows an exploded view of an assembly 900 found in a range of lamp standards adapted to be used for providing active accessories in an LED lamp. The LED lamp includes a magnet 9023, having a treated surface 902, a lens, and an emanated light pattern 904.

One embodiment disposes accessories on the face of the lamp, in a proximity that is thermally isolated from the heat source and high temperatures of the LED. In certain embodiments, the face of the lamp is open to the environment so as to facilitate heat dissipation of any electronics. Such a face-mounting further facilitates antenna placement (e.g., for wireless operation), and for camera and sensor operation. It also makes it easy to connect and disconnect accessories.

In certain embodiments, an LED lamp comprises a lens having a center and a diameter; a first magnet attached to the center of the lens; a first accessory disposed on the lens; and a second magnet attached to the center of the first accessory; wherein the first magnet and the second magnet are configured to retain the first accessory against the lens.

Figure 10A:
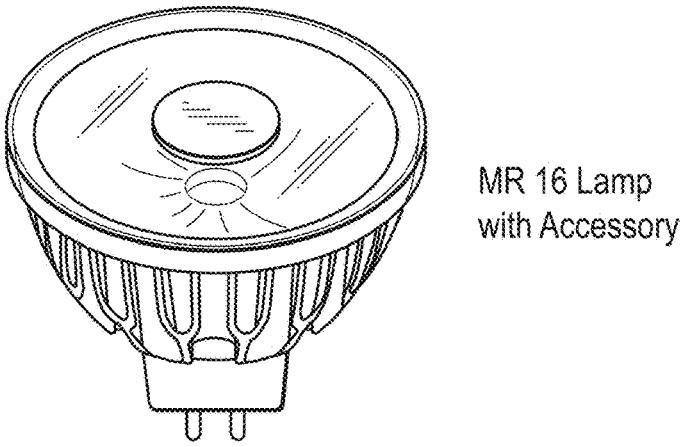
FIG. 10A depicts an assembled LED lamp with an accessory according to some embodiments.

FIG. 10A depicts an LED lamp with an accessory as an exemplary system having improved accessories for LED lamps.

Figure 10B:
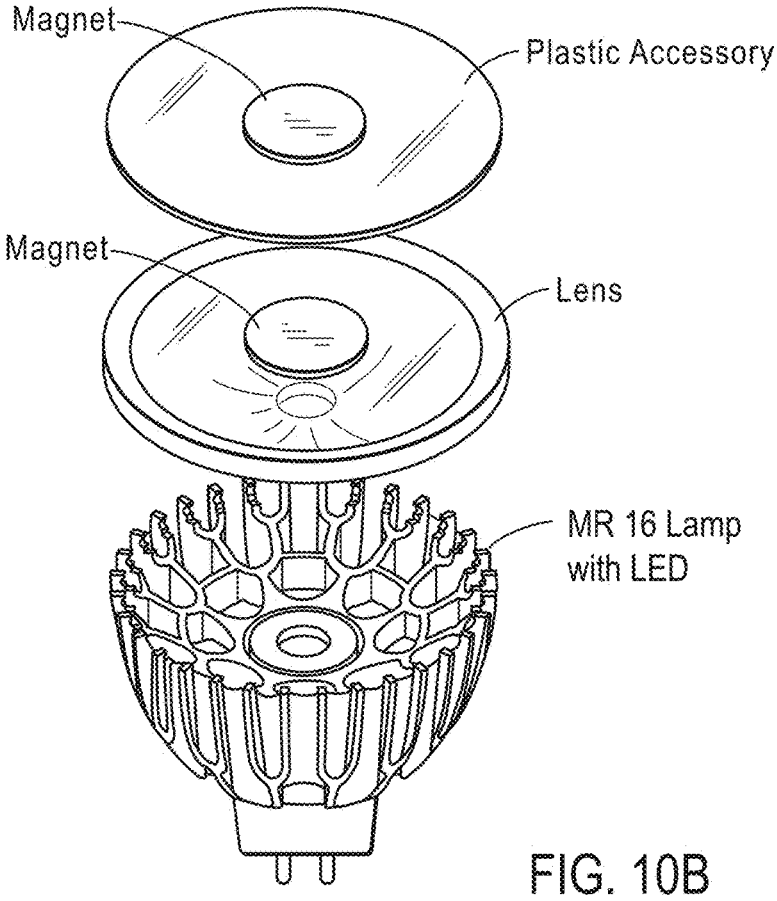
FIG. 10B shows an exploded view of an LED lamp with an accessory according to some embodiments.

FIG. 10B shows an exploded view of an LED lamp with an accessory in a system having improved accessories for LED lamps.

FIGS. 10A and 10B show an example of an LED lamp having an MR16 form factor including a heat sink. A lens is attached to the heat sink or other part of the lamp. In certain embodiments, the lens comprises a folded total internal reflection lens. Attachment may be mechanically such as using prongs as shown in FIGS. 10A and 10B. A magnet is attached to the center of the lens. An accessory having a magnet attached to the center can be disposed over the lens and the opposing magnets can hold the accessory to the lens. The first and second opposing magnets can be configured to retain the accessory against the perimeter of the lens. For example, the opposing magnets may have the opposite polarity. The accessory may have substantially the same diameter as the lens, and in certain embodiments covers an optical region of the lens, such as for example greater than 90% of the optical aperture of the LED lamp. In certain embodiments, the accessory comprises a transparent film such as for example a plastic film. In certain embodiments, the accessory is selected from a diffuser, a color filter, a polarizer, a linear dispersion element, a baffle, and a combination of any of the foregoing. In certain embodiments, the first magnet and the first accessory have a combined thickness less than about 3 mm, less than about 2 mm, less than about 1 mm, less than about 0.5 mm, and in certain embodiments, less than about 0.25 mm.

Figure 11:
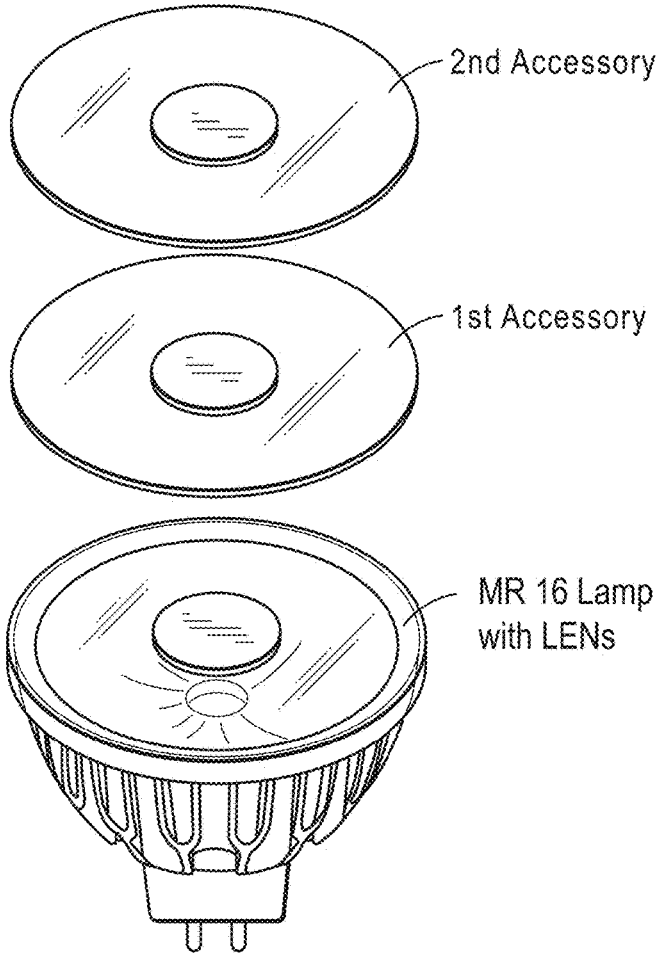
FIG. 11 shows an exploded view of an LED lamp with multiple accessories, according to some embodiments.

FIG. 11 shows an exploded view 1100 of an LED lamp with multiple accessories in a system having improved accessories for LED lamps.

In certain embodiments as shown in FIG. 11, an LED lamp comprises a second accessory disposed adjacent a first accessory. In certain embodiments, a second magnet is attached to the center of the second accessory and is used to affix the second accessory to the lamp. In certain embodiments wherein the lamp comprises a second accessory, a magnet is not attached to the center of the first accessory.

There are many configurations of LED lamps beyond the depicted MR-16 lamp. For example, Table 1 gives standards (see "Designation") and corresponding characteristics.

TABLE 1

LED lamp standards.

| Designation | Base Diameter (crest of thread) | Name | IEC 60061-1 Standard Sheet |
|---|---|---|---|
| | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, a base member (e.g., shell, casing, etc.) can be of any form factor configured to support electrical connections, which electrical connections can conform to any of a set of types or standards. For example, Table 2 gives standards (see "Type") and corresponding characteristics, including mechanical spacings.

TABLE 2 lamp electrical connection standards.

| Type | Standard | Pin (center to center) | Pin Diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |
| GX53 | | 53 mm | | Twist-lock for puck-shaped under-cabinet compact fluorescents, since 2000s |

Additionally, a lens may comprise a bulb or remote member used in forming the LED lamp. The aspect of a center can mean a center from the perspective of any center, or even a centroid (from any view) as in the case of an irregularly shaped lens.

Accessories and methods of attached accessories disclosed herein may be used with any suitable LED lamp configuration including without limitation any of those disclosed in Table 1 and/or in combination with any form factors disclosed in Table 2.

Figure 12:
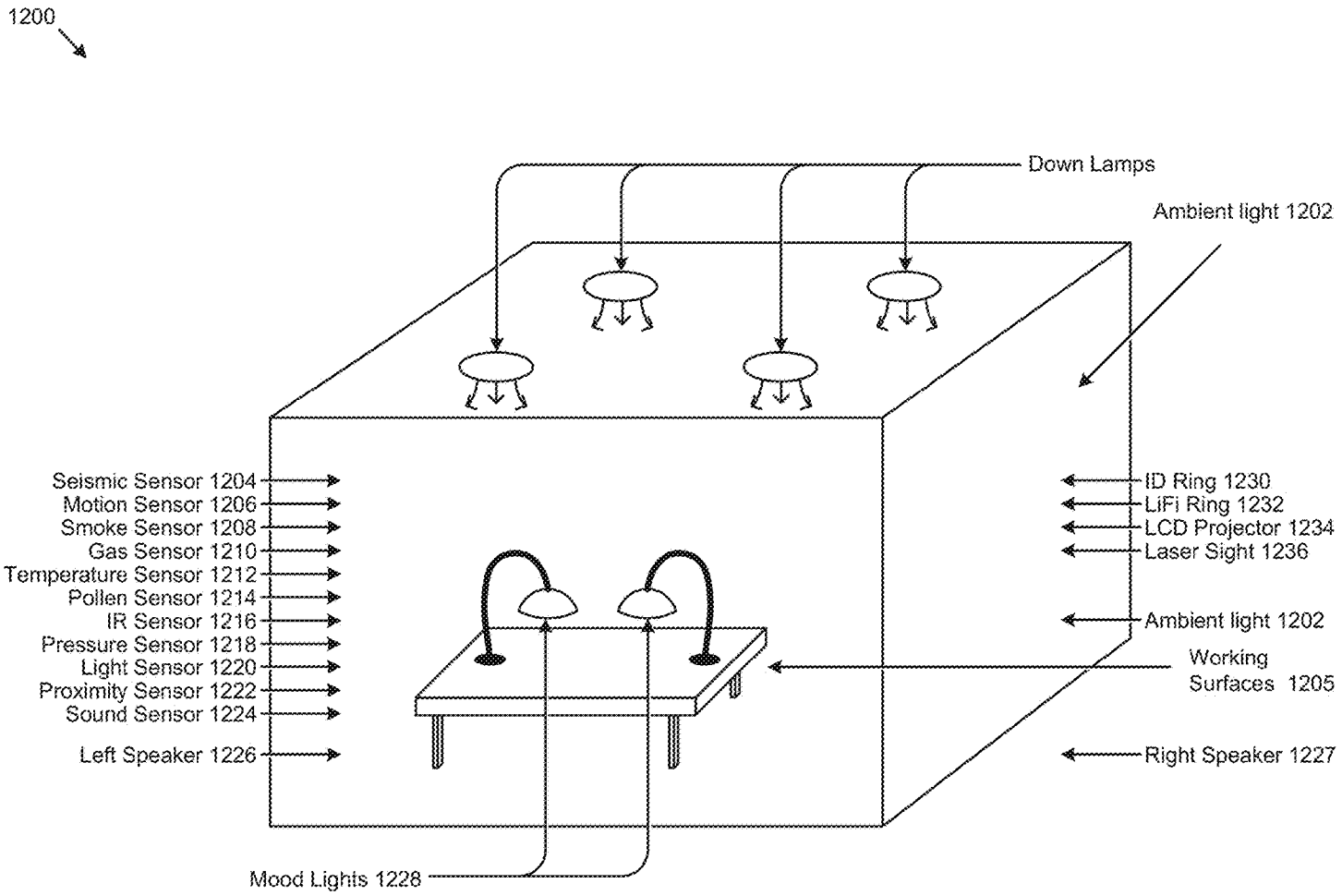
FIG. 12 depicts an environment within which LED lamps with multiple active accessories can be deployed.

FIG. 12 depicts an environment 1200 within which LED lamps with multiple active accessories can be deployed. In particular, FIG. 12 depicts an arrangement of various lights (e.g., lamps and or fixtures) positioned in a way as to provide useful illumination both for general illumination lamps (e.g., down lamps) as well as lamps for task lighting at working surfaces 1205. There may be incidental sources of light (e.g., ambient light 1202), for example, natural light or other illumination entering the environment through a window or door.

The various lights may be grouped together in a way that is commonly known as a zone. In a lighting zone, the lamps within a group act together in their potentially variable light output. One or more of the lights may have active electronic accessories attached ("SNAPs") which provide one or more various functionalities. In some situations, one or more or all of the lamps may be in communication with one or more of other lamps, and/or in communication with a controlling and/or monitoring device and/or the Internet (e.g., via a cloud-based control/monitor). One or more or all of the lamps may also have sensors to assess ambient light, motion, occupancy, temperature, IR data, proximity, gasses (e.g., CO, $CO_2$, methane, etc.), products of combustion (e.g., from fire or smoldering), smoke (e.g., cigarette smoke, compound-laden vapors, etc.), humidity, human body temperature, remote object temperature (e.g., by IR sensing) etc.

Any number of these sensors may be constructed into a SNAP form factor, and any number can be attached in any combination to one or more lamps. There may be one or more sensors (with or without wireless communication functionality) on a SNAP accessory, and there may be one or more SNAPs attached to a single lamp.

In one embodiment, a particular lamp (perhaps near a door) has a motion sensor SNAP attached. Another lamp (perhaps near a window) has an ambient light sensor. Certain lamps and/or attached SNAP accessories may have a wireless or IR communication function, and individual ones or groups of lamps can be individually or in groups as pertaining to one or more zones. Zone marking SNAPs are further discussed infra. Zone marking SNAPs may or may not be permanently affixed. In some cases a remembered zone designation may be "imparted" from an accessory to a lamp and henceforth remembered by the lamp. The impartation can occur merely through momentarily attaching a zone marking SNAP to the lamp. In such scenarios, similarly-zoned lamp can operate and/or cooperate in a group. For example, a light having a motion sensor can cause all lamps sharing the same zone designation to become activated when motion is detected. Concurrently, perhaps in the same zone or part of the zone, or in a different zone, a communication unit and/or ambient light sensor will cause certain lamps near a window to dim when incoming ambient light is sensed.

Manual control over each lamp or group of lamps can be managed under wireless control and/or under IR control, with or without intervention by an occupant of the room, or with or without intervention by an automated controller, or with or without intervention or by a remote controller located remotely from the subject lamp or group of lamps. The SNAP accessories may be freely re-deployed (e.g., to a different lamp or to a different location) and the re-deployment enables new functions corresponding to the new arrangement.

Programmed functionality may be offered by the combination of an automated controller and additional SNAPs or by the SNAPs themselves. A "Fire Egress" SNAP could designate a lamp to be always on even if dimmed 24 hours a day. An event trigger such as a detected open flame, smoke or an external signal of a fire alarm (e.g., perhaps coming through the programmed controller) being tripped can cause the lights to come to a preset maximum intensity, and/or with egress indications (e.g., illuminated arrows and/or blinking to attract attention).

Some combinations include various forms of an "Enterprise Outlook" SNAP so that an email address can become the address of a lighting system (e.g., group of lamps, similarly-zoned lamps, etc.) can become the address of a specific lamp. Strictly as one example, sending an email to lamp-on.name@domain.com might control the task light at Name's desk.

Further active elements and sample functions are given in the following tables.

TABLE 3

Sample active elements and functions.

| Active Element | Exemplary Function |
|---|---|
| "ID Ring": | Ring fitted to lap has a "zone ID" |
| Motion detector (e.g., motion sensor 1206) | Sense and report |
| Fire Egress | Always illuminated to show the egress. Flashing or blinking during periods of alert. |
| Smoke detector (e.g., smoke sensor 1208) | Sense and report |
| Carbon-monoxide detector (e.g., gas sensor 1210) | Sense and report |
| Ambient temperature sensors (e.g., temperature sensor 1212) | Sense and report |
| Ambient sound microphone | Sense and report |
| Hi-Fi speakers | |
| Pollution detector (e.g., pollen sensor 1214) | Sense and report |
| Infrared sensor (e.g., IR sensor 1216) | Sense code and report |
| Weather detector (e.g., using pressure sensor 1218) | Sense using barometer, temperature, thunder storms, etc. |
| Ambient light detector | Vary the color gamut while keeping the chromaticity fixed. |
| Diagnostic attachment | Perform lumen readings and color readings for lifetime maintenance |
| Proximity detector (e.g. proximity sensor 1222) | Sense and report |
| Maintenance sensor LLF = 1 | (constant illumination characteristics over degradation due to time or environment) |
| Combination: Zone ring, plus motion sensor | Sense and report by zone |
| Directional sound detector (e.g., sound sensor 1224) | Use 2 radios (e.g., Bluetooth Low-energy) |
| Passive light guides of various types illumination | To shape beams and/or to direct |
| SNAP location or ID accessory | To aid in indoor positioning |
| Adjust light (auto- ON/Off) | On, Off, Dimming |
| LCD accessory | Direct beam through it to change color or focus |
| Multiple rings fit together | To and pass power and control signals |
| Laser (e.g., laser sight 1236) | Sight, other detection from laser |
| Active Element | Exemplary Function |
| LiFi (e.g., LiFi ring 1232) | Re-broadcasting |
| Auto-commissioning | ring (e.g., based on ID) |
| Work/Rest | Period sensor Adjust for circadian |
| Ambient light sensor or timer (e.g., light sensor 1220) | Night light |

TABLE 3-continued

Sample active elements and functions.

| Active Element | Exemplary Function |
|---|---|
| Decorative lighting | On, Off, Dimming |
| Idiot lights | For sense or reading reporting |
| Beacon | Proximity of mobile device |
| Buzzer | Alarm(s) |
| Semi-Passive accessory | Beam shaping by turning ring |
| Motor | To aim or change beam profile |
| Add a fan | For a "cooler" |
| Rotating polarizer | To aim or change beam polarization |
| LCD imager (e.g., LCD projector 1234) | Local projection |
| Gobo | (see below) |
| Ambient/whitepoint correction sensor | For wall or object or painting — maintain chromaticity |
| Active-to-Active combinations | (see below) |
| Acoustic Transducer (e.g., left speaker 1226, right speaker 1227) | Music reproduction: Left and right can be set or sensed by the zone ring |
| Zone ring, zone controller (e.g., ID ring 1230, etc.) | Zone ring controls color temperature, time (e.g., for circadian cycle) |
| Mood lights that are responsive to microphone and mood detector processor | Use in a mood-setting mode (e.g., using one or more mood lights 1228). The lamp adjusts colors dependent on music played, etc. |
| SNAP elements that go onto a magnet disposed at ring (not over glare blocker) | For multi-function flexibility |
| Seismic activity sensor (e.g. seismic sensor 1204) and warning | Detect seismic activity, filter to reduce false alarms, and signal warning (e.g., at one lamp or at a group of lamps) |

Any of the active accessories, singly or in combination can be deployed onto or with a compatible lamp.

Figure 13:
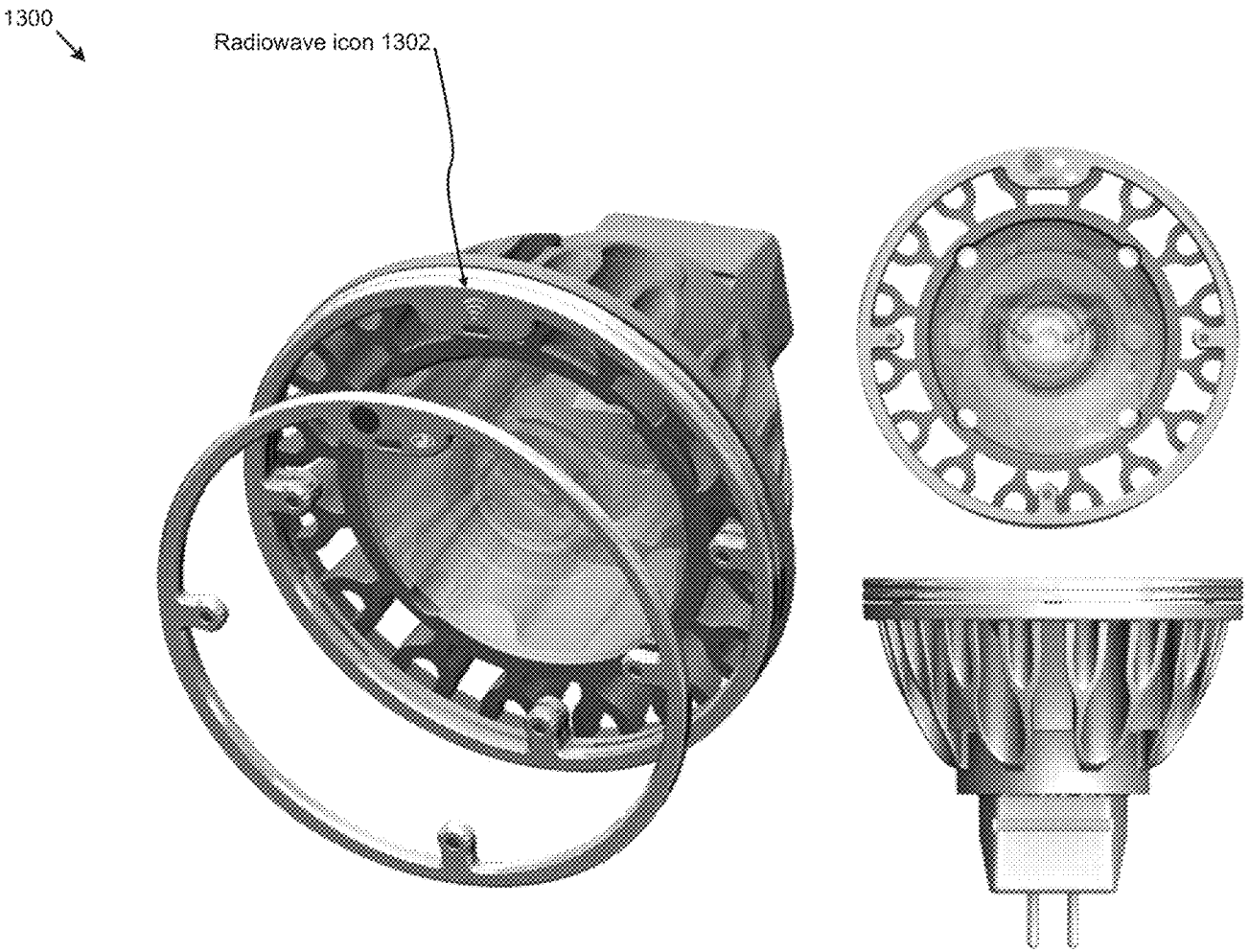
FIG. 13 depicts a selection of views of a lamp having an attachment about the periphery of the lamp face as used for hosting active accessories, according to one embodiment.

FIG. 13 depicts a selection of views 1300 of a lamp having an attachment about the periphery of the lamp face as used for hosting active accessories.

Figure 22:
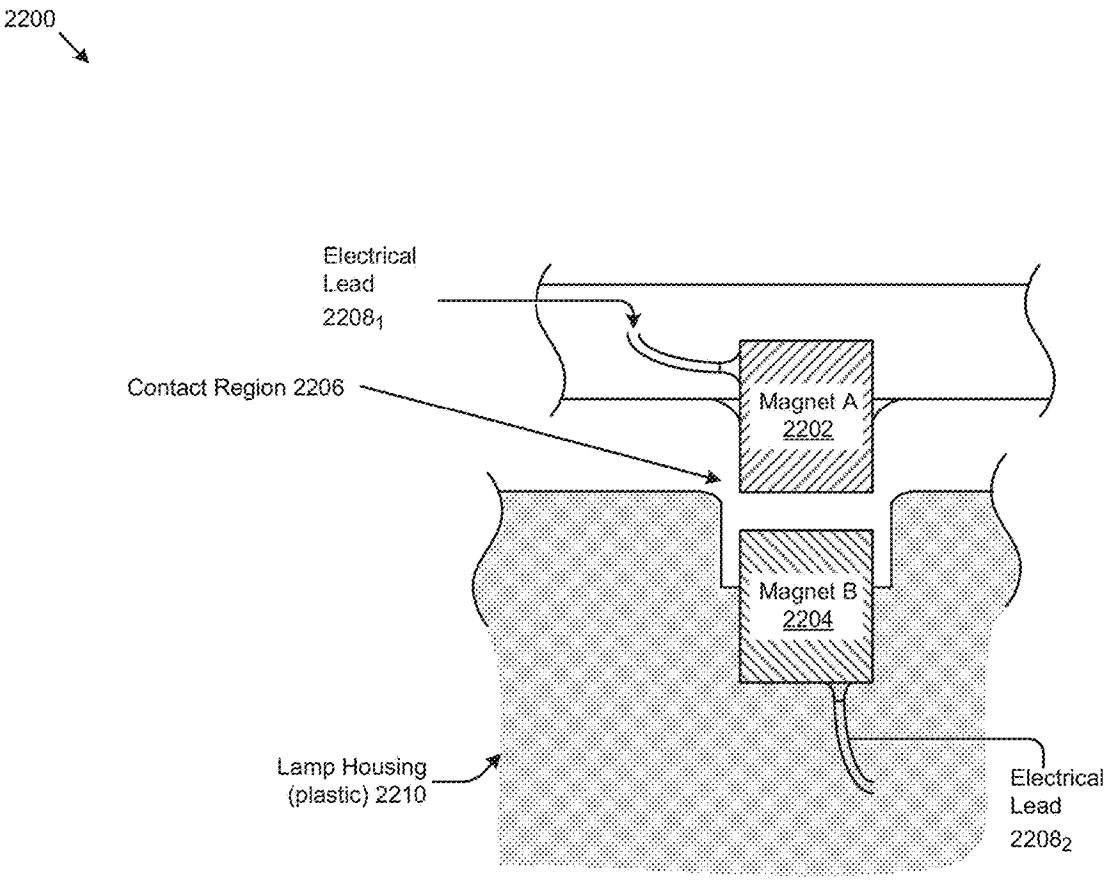
FIG. 22 depicts a side side-view cutaway to show use of two or more magnets to form an electrical contact, according to one embodiment.

As shown in FIG. 13, the views depict an MR-16 lamp comprising a lens having a periphery with border magnets embedded about a periphery of the lens. A particular periphery can be the outermost periphery of the lamp, or can be an inner periphery, and can be placed (as shown) abutting a border. The shown border about an inner core. A first set of border magnets with a particular polarity can be embedded about a periphery of the lens, for example within the recess of a contact region. A second set of border magnets with a particular polarity can be embedded about a periphery of an accessory. The contact region is large enough such that a first border magnet positioned at the inner core can be in contact with a second border magnet positioned in a periphery of an accessory, and the contact between the two magnets can form an electrical connection. As shown, there are four contact regions, any or all of which can carry driving voltages, and/or signals, or both (e.g., a DC driving voltage and a voltage variation superimposed on the DC driving voltage). FIG. 22 shows a side-view cutaway to show a technique to use the magnets to form an electrical contact while simultaneously providing an attractive force to position the accessory over the lamp base or heat sink, or inner core.

As shown, an accessory is in contact with the lens periphery using border magnets. As shown, the first accessory hosts active functions, one of which is a wireless device (e.g., WiFi, Bluetooth, etc.). The accessory may include an icon (e.g., the wireless icon 1302, as shown).

Figure 14:
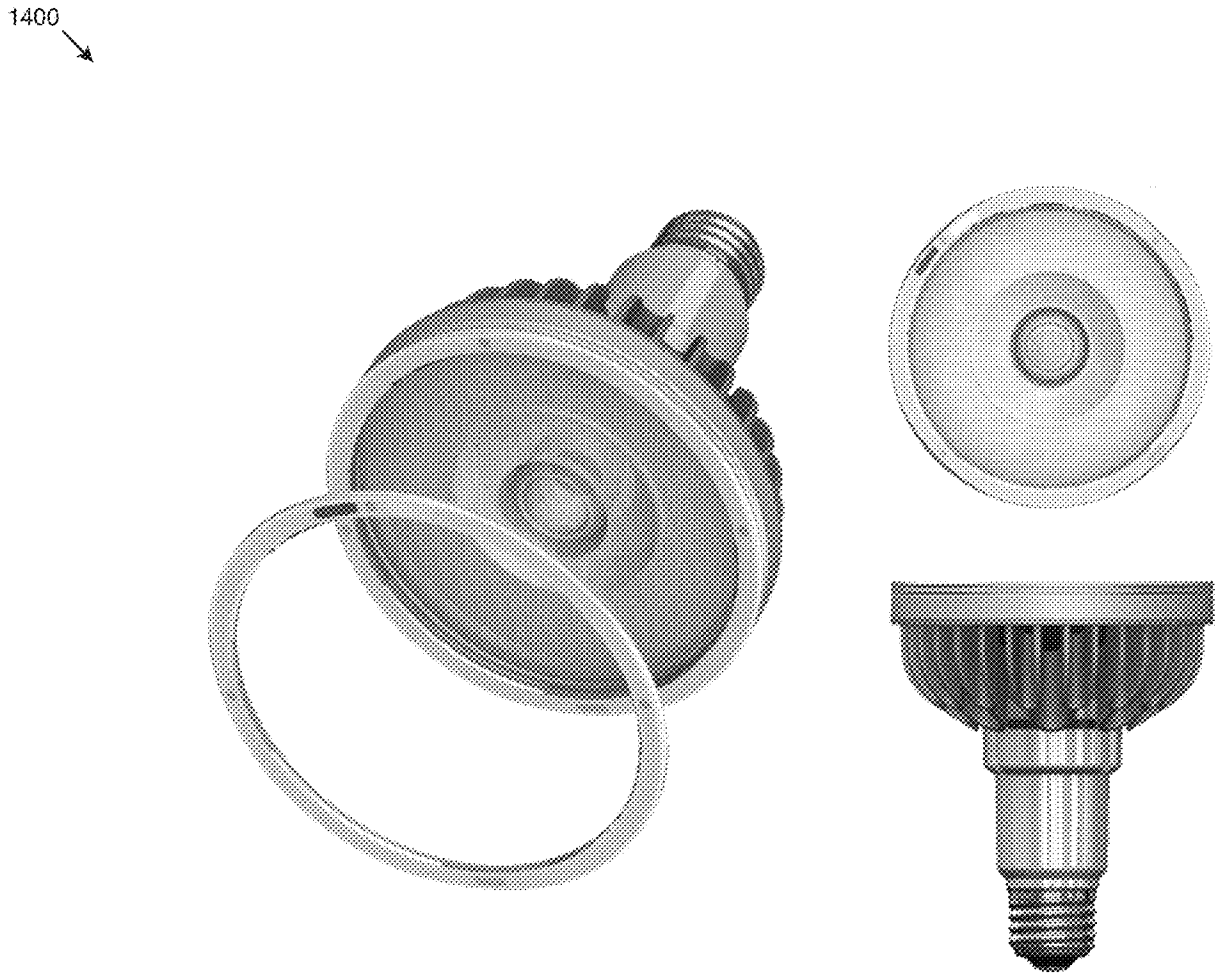
FIG. 14 depicts a selection of views of a PAR lamp having an attachment about the periphery of a PAR lamp face as used for hosting active accessories, according to one embodiment.

FIG. 14 depicts a selection of views 1400 of a PAR lamp having an attachment about the periphery of a PAR lamp face as used for hosting active accessories.

The views of FIG. 14 depict a PAR lamp comprising a lens having a periphery with a first magnet attached to the periphery of the lens. An accessory is in contact with the lens periphery using the magnet. As shown, the first accessory hosts active functions, one of which is a zone ID indicator.

Figure 15:
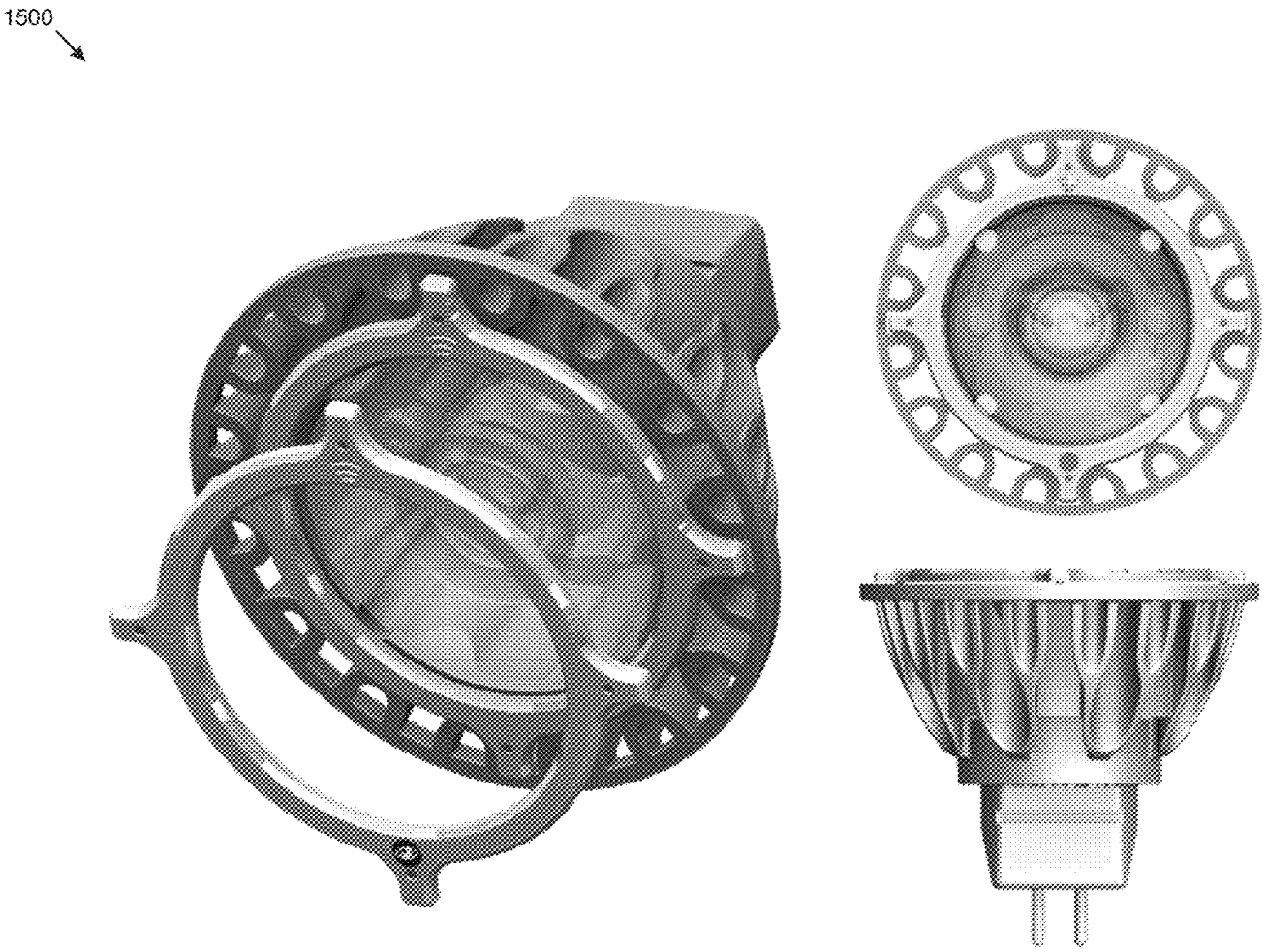
FIG. 15 depicts a selection of views of an MR-16 lamp having an auto-centering attachment positioned about the periphery of an MR-16 lamp face as used for hosting active accessories, according to one embodiment.

FIG. 15 depicts a selection of views 1500 of an MR-16 lamp having an auto-centering attachment positioned about the periphery of an MR-16 lamp face as used for hosting active accessories.

The views depict an MR-16 lamp comprising a lens having an inner periphery with a first magnet attached to the inner periphery of the lens. A first accessory is disposed to be in contact with the lens periphery using the magnet. As shown, the first accessory hosts active functions, one of which is a wireless device (e.g., WiFi, Bluetooth, etc.). The second accessory is disposed in contact with the first accessory. As shown, the second accessory hosts active functions, one of which is a wireless device (e.g., WiFi, Bluetooth, etc.).

Figure 16:
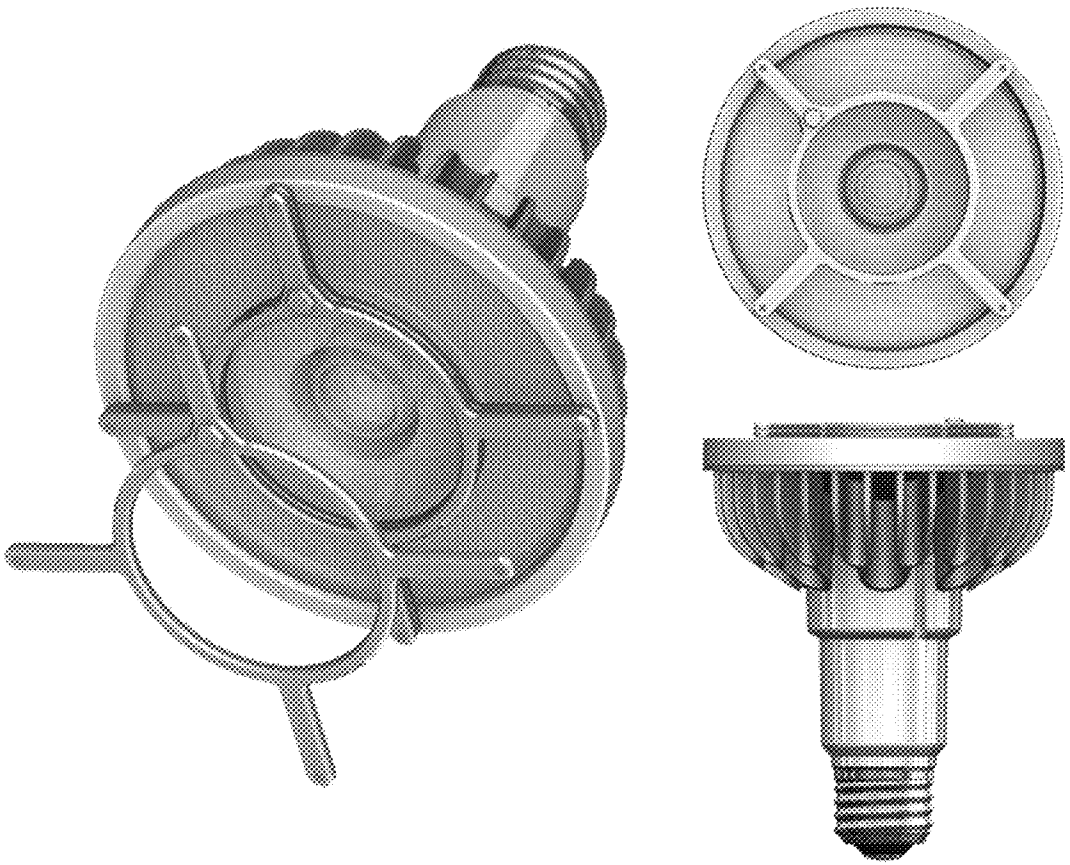
FIG. 16 depicts a selection of views of an PAR lamp having periphery attachment points positioned about the periphery of a PAR lamp face as used for hosting active accessories, according to one embodiment.

FIG. 16 depicts a selection of views 1600 of a PAR lamp having periphery attachment points positioned about the periphery of a PAR lamp face as used for hosting active accessories.

The views depict a PAR lamp comprising a lens having an inner periphery with a first magnet attached to the inner periphery of the lens. A first accessory is disposed to be in contact with the lens periphery using the magnet. As shown, the first accessory hosts active functions, one of which is a zone ID. The second accessory is disposed in contact with the first accessory. As shown, the second accessory hosts active functions, one of which is a pressure sensor.

Figure 17:
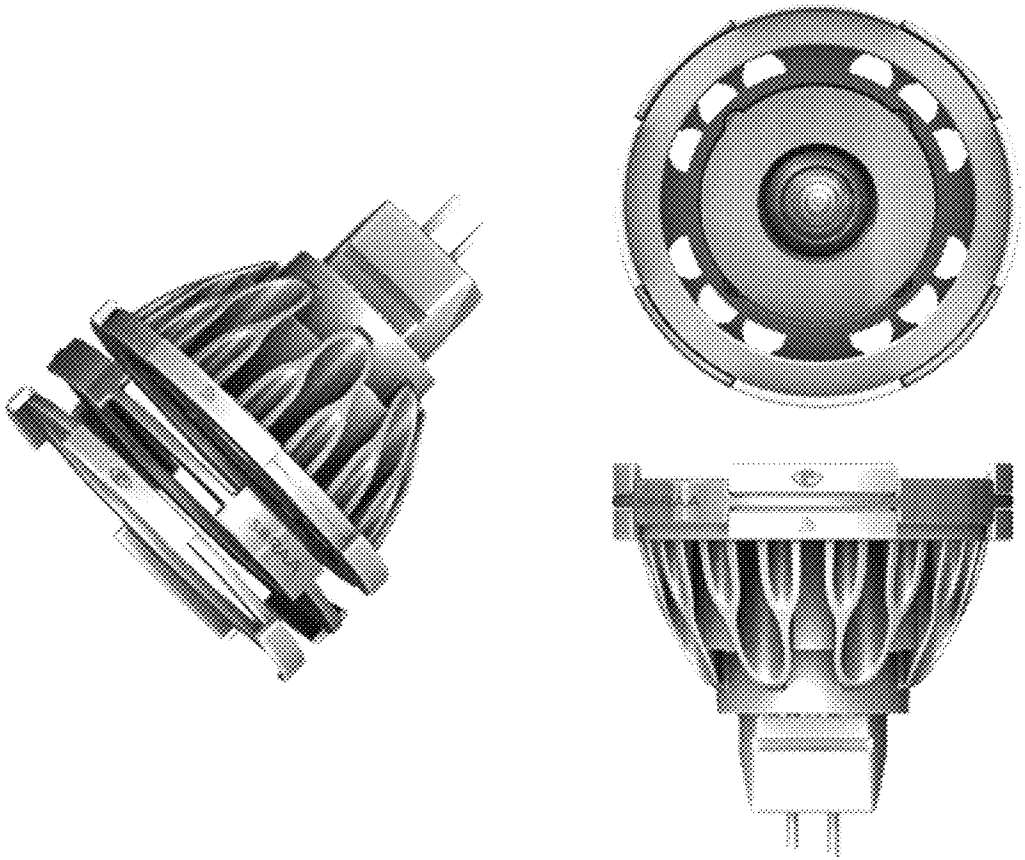
FIG. 17 depicts a selection of views of an MR-16 lamp having keyed attachment points positioned about the periphery of an MR-16 lamp face as used for hosting active accessories, according to one embodiment.

FIG. 17 depicts a selection of views 1700 of an MR-16 lamp having keyed attachment points positioned about the periphery of an MR-16 lamp face as used for hosting active accessories.

As shown, a second accessory is keyed to mate into a first accessory in pre-determined juxtaposition, and the first accessory is keyed to mate into an MR-16 lens or housing in pre-determined juxtaposition.

Figure 18:
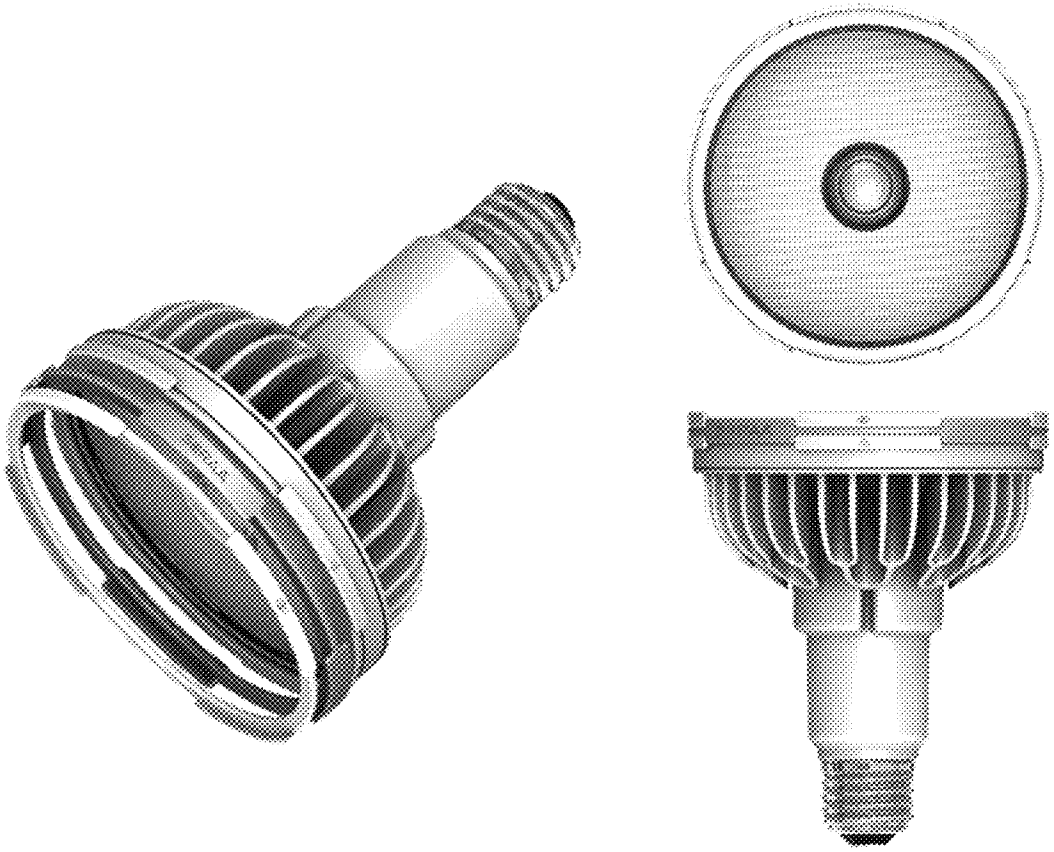
FIG. 18 depicts a selection of views of a PAR lamp having keyed attachment points positioned about the periphery of a PAR lamp face as used for hosting active accessories, according to one embodiment.

FIG. 18 depicts a selection of views 1800 of a PAR lamp having keyed attachment points positioned about the periphery of a PAR lamp face as used for hosting active accessories.

As shown, a second accessory is keyed to mate into a first accessory in pre-determined juxtaposition, and the first accessory is keyed to mate into a PAR lens or housing in pre-determined juxtaposition.

Figure 19:
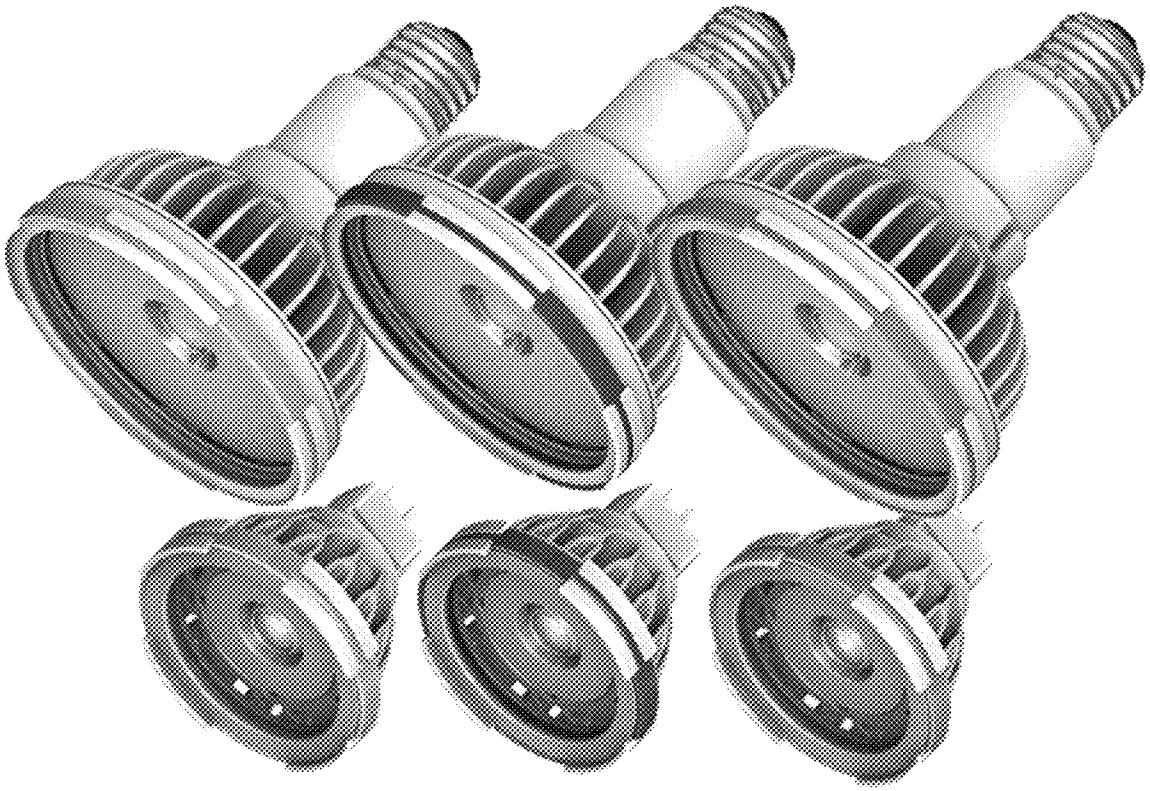
FIG. 19 depicts a selection of views of a PAR lamp having color-coded keyed attachment points positioned about the periphery of a PAR lamp face as used for hosting active accessories, according to one embodiment.

FIG. 19 depicts a selection of views 1900 of a PAR lamp having color-coded keyed attachment points positioned about the periphery of a PAR lamp face as used for hosting active accessories.

As shown, a second accessory is color-coded and is keyed to mate into a first accessory in pre-determined juxtaposition, and the first accessory is also color-coded and keyed to mate into a PAR lens or housing in pre-determined juxtaposition.

Figure 20:
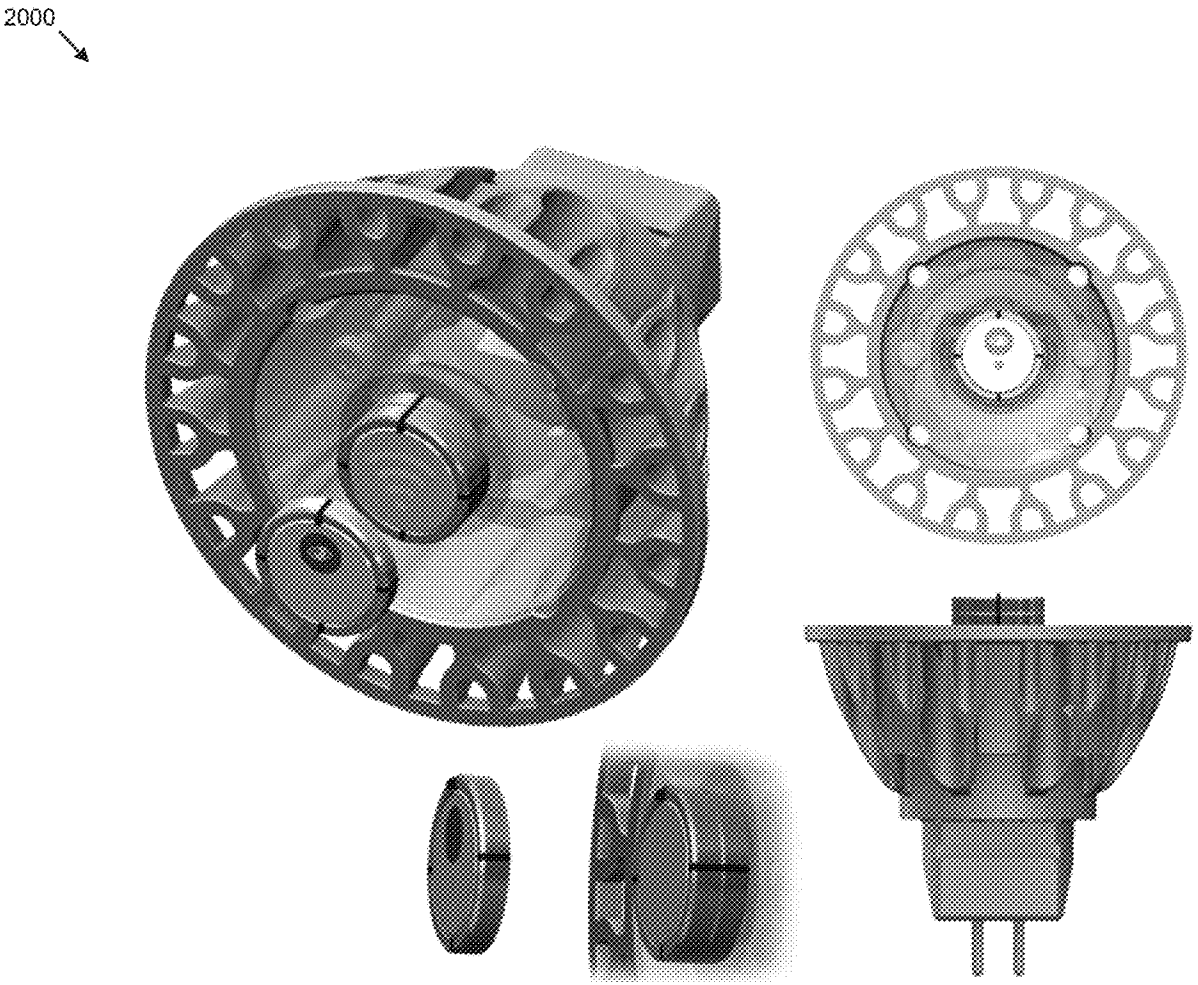
FIG. 20 depicts a selection of views of an MR-16 lamp having zone ID glare blocker for use on a lamp face as used with active accessories, according to one embodiment.

FIG. 20 depicts a selection of views 2000 of an MR-16 lamp having zone ID glare blocker for use on a lamp face as used with active accessories.

Figure 21:
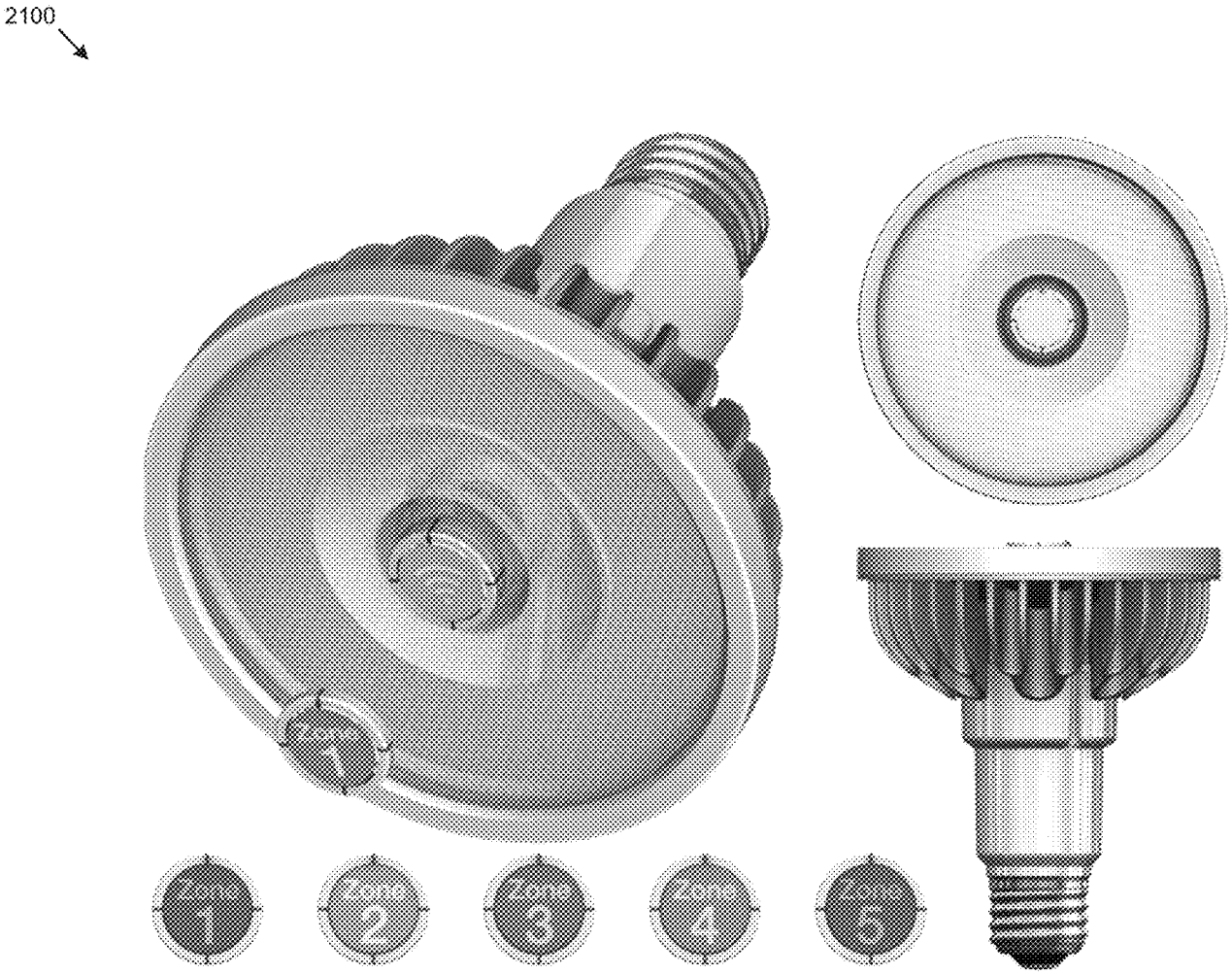
FIG. 21 depicts a selection of views of a PAR lamp having zone ID glare blockers for positioning on a lamp face as used with active accessories, according to one embodiment.

FIG. 21 depicts a selection of views 2100 of a PAR lamp having zone ID glare blockers for positioning on a lamp face as used with active accessories.

The views of FIG. 2*l* depict color-coded zone ID glare blockers.

Combinations of a plurality of magnets and glare blockers can be found in various embodiments. The following embodiments are presented, strictly as examples:

In certain embodiments, a light emitting diode (LED) lamp comprises: a lens having a periphery; a first magnet attached to the periphery of the lens; and a first accessory wherein the first accessory is in contact with a periphery of the lens using the magnet; and wherein the first accessory comprises at least one active function.

In certain embodiments of an LED lamp, the active function comprises a motion sensor.

In certain embodiments of an LED lamp, the active function comprises a smoke sensor.

In certain embodiments of an LED lamp, the active function comprises a gas presence sensor.

In certain embodiments of an LED lamp, the active function comprises a temperature sensor.

In certain embodiments of an LED lamp, the active function comprises a pressure sensor.

In certain embodiments of an LED lamp, the active function comprises an ambient light sensor.

In certain embodiments of an LED lamp, the active function comprises a sound sensor.

In certain embodiments of an LED lamp, the active function comprises a left speaker.

In certain embodiments of an LED lamp, the active function comprises a right speaker.

In certain embodiments of an LED lamp, the active function comprises a mood light.

In certain embodiments of an LED lamp, the lamp further comprises a second accessory having a second magnet wherein the first magnet and the second magnet are configured to retain the first accessory against the second accessory.

In certain embodiments of an LED lamp, the first magnet and the second magnet are configured to mate with the perimeter of the lens.

In certain embodiments of an LED lamp, the first accessory has a diameter that is substantially equal to a diameter of the lens.

E In certain embodiments of an LED lamp, the first accessory has a diameter that is equal to a diameter of the lens.

In certain embodiments of an LED lamp, the first accessory has a diameter that substantially covers an optical region of the lens.

In certain embodiments of an LED lamp, the lens is configured to attach to an MR16 lamp.

In certain embodiments of an LED lamp, the second accessory is selected from a diffuser, a color filter, a polarizer, a linear dispersion element, a baffle, and a combination of any of the foregoing In certain embodiments of an LED lamp, the first magnet and the first accessory have a combined thickness less than 1 mm.

In certain embodiments of an LED lamp, the lens comprises a folded total internal reflection lens.

In certain embodiments of an LED lamp, the lamp is characterized by a lamp output mechanical aperture; and the lens is configured to cover more than 90% of the lamp output mechanical aperture.

In certain embodiments of an LED lamp, the LED lamp of embodiment 1, further comprising a second accessory having a magnet disposed about a center of the second accessory.

In certain embodiments of an LED lamp, second accessory comprises a third magnet, wherein the third magnet is attached to the center of the second accessory.

In certain embodiments, an apparatus for providing active accessories in a light emitting diode (LED) lamp, comprises: an LED illumination product having a lens and a housing; at least one electronic component disposed within the housing; at least two electrical conductors electrically-connected to the at least one electrical component, the at least two electrical conductors disposed within a rigid member affixed to the lens; and a first accessory wherein the first accessory is in contact with the lens using a magnet and wherein the first accessory comprises at least one active function.

In certain embodiments of an apparatus, the rigid member accepts a USB connector.

In certain embodiments of an apparatus, the rigid member is made of a magnetic material.

In certain embodiments of an apparatus, the rigid member is affixed to the lens with an adhesive.

In certain embodiments of an apparatus, the rigid member is affixed to a periphery of the lens using a mechanical connector.

In certain embodiments of an apparatus, the rigid member is affixed to a center of the lens using a mechanical connector.

In certain embodiments, a light emitting diode (LED) lamp comprises: a lens having a periphery; a first magnet attached to the periphery of the lens; a first accessory wherein the first accessory is in contact with a periphery of the lens using the magnet; and wherein the first accessory comprises at least one first active function; and a second accessory wherein the second accessory is in contact with the first accessory and wherein the second accessory comprises at least one second active function.

In certain embodiments of an LED lamp, the first active function comprises a zone ID and the second active function comprises a wireless device.

In certain embodiments of an apparatus, the first active function comprises a color-coded zone ID and the second active function comprises a wireless device.

In certain embodiments of an apparatus, the first active function comprises a zone ID and the second active function comprises a Bluetooth wireless device.

In certain embodiments of an apparatus, the first active function comprises a zone ID and the second active function comprises a WiFi wireless device.

In certain embodiments of an apparatus, the first active function comprises a zone ID and the second active function comprises a smoke sensor.

In certain embodiments of an apparatus, the first active function comprises a zone ID and the second active function comprises an ambient light sensor.

In certain embodiments of an apparatus, the first active function comprises a zone ID and the second active function comprises a seismic sensor.

In certain embodiments of an apparatus, the first active function comprises a zone ID and the second active function comprises a gas presence sensor.

In certain embodiments of an apparatus, the first active function comprises a zone ID and the second active function comprises a wireless device.

In certain embodiments of an apparatus, the first active function comprises a zone ID and the second active function comprises a pressure sensor.

FIG. 22 depicts a side side-view cutaway to show use of two or more magnets to form an electrical contact. As shown, a first border magnet (e.g., magnet B 2204) is embedded in a lamp housing 2210. A second border magnet (e.g., magnet A 2202) is embedded in an accessory. A first electrical lead $\mathbf{2208}_1$ carries current, and a second electrical lead $\mathbf{2202}_2$ also carries a current. When first border magnet is in contact with second border magnet (e.g. at the point shown as contact region 2206) current can be carries through first border magnet to second border magnet and through electrical leads, and the current can be used to provide power to an active accessory.

Finally, it should be noted that there are alternative ways of implementing the embodiments disclosed herein. Accordingly, the present embodiments are to be considered as illustrative and not restrictive, and the claims are not to be limited to the details given herein, but may be modified within the scope and equivalents thereof.

What is claimed is:

1. An LED lamp for connection to a light fixture in combination with a network of other lamps in different light fixtures, said LED lamp comprising:

a housing defining an exterior having a base;

an electrical interface at said base, said electrical interface being configured for releasable mechanical and electrical connection to a lamp socket of said light fixture;

a light source disposed in said housing;

at least one electronic component disposed in said housing;

a first connector being accessible from said exterior of said housing and being electrically connected to said at least one electrical component;

a light emitting surface, said first connector being disposed on said light emitting surface; and a smart module having a microprocessor and a second connector releasably connected to said first connector, wherein said smart module is removable from said first connector and wherein connecting said first and second connectors provides power to said smart module, and said microprocessor is configured to communicate over said network to monitor and control said other lamps in said different light fixtures.

2. The LED lamp of claim 1, wherein said at least one electronic component is at least one of a microprocessor, readable storage, power supply, power conditioning circuitry, or a second sensor.

3. The LED lamp of claim 1, wherein said at least one electronic component is a power source, thereby proving power to said first connector.

4. The LED lamp of claim 1, wherein said at least one electronic component is a microprocessor configured for controlling an LED driver and storing operational data.

5. The LED lamp of claim 1, wherein said at least one electronic component is smart light electronics and said first connector is an expansion slot electrically connected to said smart light electronics.

6. The lamp of claim 1, wherein said smart module comprises at least one of a sensor, camera, or networking module.

7. The LED lamp of claim 1, wherein said smart module is a slave device or a master device.

8. The LED lamp of claim 1, wherein said microprocessor is configured to communicate wirelessly.

9. The LED lamp of claim 1, wherein said smart module is configured to facilitate communication to a peripheral device.

10. The LED lamp of claim 9, wherein said peripheral device is at least one of a camera or a sensor.

11. The LED lamp of claim 1, wherein said at least one electronic component is a readable storage configured for storing operational data, and wherein said microprocessor is configured to read said readable storage.

12. The LED lamp of claim 1, wherein said LED lamp is monitored and controlled by said smart module.

13. The LED lamp of claim 1, wherein said first connector is configured to receive more than one type of smart module.

14. The LED lamp of claim 1, wherein said first connector is a USB connector.

15. The LED lamp of claim 1, wherein said housing comprises at least a lens and said first connector is disposed within said lens.

16. The LED lamp of claim 1, wherein said first connector comprises a magnet.

17. The LED lamp of claim 1, wherein said first connector comprises a key to ensure only one type of smart module is connected.

18. The LED lamp of claim 1, wherein said smart module comprises at least one sensor.

19. The LED lamp of claim 1, wherein said first connector is distant from said base.

20. The LED lamp of claim 1, wherein said network of other lamps is a lighting zone.

21. The LED lamp of claim 20, wherein said network of other lamps in a lighting zone vary their light together.

22. The LED lamp of claim 1, wherein said smart module is in communication with a controller or a cloud-based monitor.

23. A network comprising:

a plurality of lamps connected to a plurality of light sockets in different light fixtures, at least one of said lamps comprising at least:

a housing defining an exterior having a base;

an electrical interface at said base, said electrical interface being configured for electrical connection to said lamp socket of a light fixture;

a light source disposed entirely within said housing;

a first connector being accessible from the exterior of said housing;

a light emitting surface, said first connector being disposed on said light emitting surface; and a smart module having a microprocessor and a second connector releasably connected to said first connector, wherein said smart module is removable from said first connector and wherein connecting said first and second connectors provides power to said smart module and enables said microprocessor to communicate over said network to monitor and control other lamps of said plurality of lamps.

24. The network of claim 23, wherein said smart module is a first smart module; and wherein each of said other lamps comprises a second smart module configured to communicate with said smart module.

25. The network of claim 24, wherein said first smart module and said second smart module comprise unique identifiers.

26. The network of claim 23, wherein said first connector is electrically connected to the power supply of said light source.

27. The network of claim 23, wherein said smart module is configured to communicate wirelessly over said network.

28. The network of claim 23, wherein said microprocessor is configured to read a readable storage of said at least one of said lamps and to communicate over said network to monitor and control said light source.

29. An LED lamp, comprising:

a housing defining an exterior having a base;

an electrical interface at said base, said electrical interface being configured for electrical connection to a lamp socket of a light fixture;

a light source disposed in said housing;

at least one electronic component disposed in said housing; and at least first connector being accessible from said exterior of said housing and being electrically connected to said at least one electrical component;

a light emitting surface and said first connector is disposed on said light emitting surface; and a smart module having a microprocessor and a second connector releasably connected to said first connector such that connecting said first and second connectors provides power to said smart module, said smart module configured to monitor and control said lamp.

* * * * *